US012473666B2

(12) United States Patent
Uchino

(10) Patent No.: US 12,473,666 B2
(45) Date of Patent: Nov. 18, 2025

(54) PILE FABRIC

(71) Applicant: UCHINO Co., Ltd., Tokyo (JP)

(72) Inventor: Nobuyuki Uchino, Tokyo (JP)

(73) Assignee: UCHINO CO., LTD., Tokyo (JP)

( * ) Notice: Subject to any disclaimer, the term of this patent is extended or adjusted under 35 U.S.C. 154(b) by 115 days.

(21) Appl. No.: 16/958,623

(22) PCT Filed: Dec. 28, 2017

(86) PCT No.: PCT/JP2017/047354
§ 371 (c)(1),
(2) Date: Jun. 26, 2020

(87) PCT Pub. No.: WO2019/130579
PCT Pub. Date: Jul. 4, 2019

(65) Prior Publication Data
US 2021/0062373 A1 Mar. 4, 2021

(51) Int. Cl.
*D02G 3/28* (2006.01)
*D02G 3/34* (2006.01)
(Continued)

(52) U.S. Cl.
CPC ..... *D02G 3/28* (2013.01); *D02G 3/34* (2013.01); *D03D 15/00* (2013.01); *D03D 15/217* (2021.01);
(Continued)

(58) Field of Classification Search
None
See application file for complete search history.

(56) References Cited

U.S. PATENT DOCUMENTS 2,012,719 A * 8/1935 Holt ..... D03D 27/08 139/391
2,371,199 A * 3/1945 Walliser ..... D03D 27/06 139/402
(Continued)

FOREIGN PATENT DOCUMENTS

CN 201080533 Y * 7/2008 ..... D03D 27/02
CN 104718321 A 6/2015
(Continued)

OTHER PUBLICATIONS

Gorjanc, Dunja Šajn, and Neža Sukič. "Determination of Optimum Twist Equation for the Long Staple Combed Cotton Ring-Spun Yarn." MDPI, Multidisciplinary Digital Publishing Institute, 21 Sep. 2020, https://www.mdpi.com/2079-6439/8/9/59/htm. (Year: 2020).*
(Continued)

*Primary Examiner* — Grace Huang
(74) *Attorney, Agent, or Firm* — MASUVALLEY & PARTNERS; Peter Martinez

(57) ABSTRACT

Provided is a pile fabric that can provide both a soft touch feel and durability (pile retention and/or suppression of pile loss). The pile fabric is provided with a base structure formed from a warp and weft and a loop pile formed from pile yarn. The pile yarn is twisted yarn with a twist factor of 2.0 or greater. When the pile yarn is untwisted yarn or weakly twisted yarn, insoluble yarn prior to water soluble yarn elimination is twisted yarn with a twist factor of 2.0 or greater. The proportion of pile height to pile yarn diameter is 40× or greater. The gap between adjacent pile yarn strands is 0.5 mm or less. The pile yarn is 50-120 English yarn count. The loop pile has snarling, and the snarling for adjacent piles is entangled.

11 Claims, 13 Drawing Sheets

(51) Int. Cl.

| | |
|---|---|
| ***D03D 15/00*** | (2021.01) |
| ***D03D 15/217*** | (2021.01) |
| ***D03D 15/283*** | (2021.01) |
| ***D03D 15/41*** | (2021.01) |
| ***D03D 27/02*** | (2006.01) |

(52) U.S. Cl.
CPC ..... *D03D 15/283* (2021.01); *D03D 15/41* (2021.01); *D03D 27/02* (2013.01); *D10B 2401/024* (2013.01); *D10B 2503/00* (2013.01)

(56) References Cited

U.S. PATENT DOCUMENTS

| | | | | | |
|---|---|---|---|---|---|
| 2,379,085 | A * | 6/1945 | Kahn | D05C 17/02 | 112/411 |
| 2,486,942 | A * | 11/1949 | Groat | D03D 27/12 | 139/403 |
| 2,486,963 | A * | 11/1949 | Miller | D05C 17/02 | 28/167 |
| 2,499,406 | A * | 3/1950 | Miller | D03D 27/00 | 112/410 |
| 2,655,950 | A * | 10/1953 | Mills | D03D 27/08 | 139/396 |
| 2,718,243 | A * | 9/1955 | Matthews | D03D 27/12 | 139/401 |
| 2,796,654 | A * | 6/1957 | Ashcroft | D05C 17/026 | 112/80.71 |
| 2,936,569 | A * | 5/1960 | Mull | D02G 3/28 | 57/239 |
| 3,721,272 | A * | 3/1973 | Hager | D03D 27/08 | 26/69 R |
| 4,408,446 | A * | 10/1983 | Wilkie | D02J 1/08 | 28/220 |
| 4,701,518 | A * | 10/1987 | Osborn | D06M 11/62 | 528/319 |
| 4,726,400 | A * | 2/1988 | Heiman | D03D 27/08 | 139/396 |
| 4,825,499 | A * | 5/1989 | Baptiste | A47K 7/02 | 2/167 |
| 4,901,517 | A * | 2/1990 | Fisher | D01H 5/26 | 19/252 |
| 4,998,419 | A * | 3/1991 | Moore | D04B 1/02 | 66/25 |
| 5,443,881 | A * | 8/1995 | Higgins | D06N 7/0073 | 428/95 |
| 5,745,961 | A * | 5/1998 | Okawa | D03D 13/00 | 24/442 |
| 6,076,242 | A * | 6/2000 | Kasaoka | D03D 15/567 | 428/92 |
| 6,468,621 | B1 * | 10/2002 | Landau | A47G 27/0225 | 428/95 |
| 6,854,146 | B2 * | 2/2005 | Stoyles | D06B 11/0059 | 700/133 |
| 8,053,379 | B2 * | 11/2011 | Tingle | D03D 15/513 | 428/92 |
| 8,578,972 | B2 * | 11/2013 | Duan | D03D 15/33 | 139/420 R |
| 8,596,305 | B2 * | 12/2013 | Govindaswamy | D03D 15/68 | 139/420 R |
| 8,733,075 | B2 * | 5/2014 | Mandawewala | D02G 3/38 | 139/1 R |
| 9,551,098 | B2 * | 1/2017 | Reiter | D01G 13/00 | |
| 9,828,704 | B2 * | 11/2017 | Goenka | D03D 27/08 | |
| 9,850,599 | B2 * | 12/2017 | Stewart | D03D 27/08 | |
| 10,196,764 | B2 * | 2/2019 | Asano | D02G 3/406 | |
| 10,463,203 | B2 * | 11/2019 | Hozumi | D03D 27/02 | |
| 10,837,132 | B2 * | 11/2020 | Hozumi | D03D 19/00 | |
| 10,925,339 | B2 * | 2/2021 | Ogata | A47G 9/02 | |
| 2003/0203152 | A1 * | 10/2003 | Higgins | D06N 7/0086 | 428/95 |
| 2004/0128811 | A1 * | 7/2004 | Mandawewala | D02G 3/406 | 28/159 |
| 2007/0087162 | A1 | 4/2007 | Mandawewala | | |
| 2007/0178790 | A1 * | 8/2007 | Gardner | D03D 27/00 | 442/190 |
| 2014/0317865 | A1 * | 10/2014 | Krishna | D03D 15/00 | 15/209.1 |
| 2016/0037977 | A1 | 2/2016 | Hozumi | | |
| 2016/0206026 | A1 | 7/2016 | Hozumi | | |
| 2016/0208420 | A1 * | 7/2016 | Hozumi | D03D 27/08 | |
| 2017/0088986 | A1 * | 3/2017 | Gupta | D03D 27/08 | |
| 2017/0182735 | A1 | 6/2017 | Groten et al. | | |
| 2018/0289238 | A1 * | 10/2018 | Vogt | B32B 25/10 | |
| 2019/0053565 | A1 * | 2/2019 | Baptiste | A42B 3/105 | |
| 2020/0190718 | A1 * | 6/2020 | Chand | D05C 17/02 | |

FOREIGN PATENT DOCUMENTS

| | | | | | |
|---|---|---|---|---|---|
| CN | 105531411 | A | | 4/2016 | |
| CN | 105579631 | A | | 5/2016 | |
| CN | 111254554 | A | * | 6/2020 | D03D 27/08 |
| EP | 3141643 | A2 | | 3/2017 | |
| GB | 408728 | A | * | 4/1934 | D03D 27/08 |
| JP | 7-97745 | A | | 4/1995 | |
| JP | 09078396 | A | * | 3/1997 | D03D 27/00 |
| JP | H0978396 | A | | 3/1997 | |
| JP | 2000-079072 | A | | 3/2000 | |
| JP | 2008025055 | A | * | 2/2008 | D04B 1/04 |
| JP | 3152796 | U | | 8/2009 | |
| JP | 2014-163004 | A | | 9/2014 | |
| JP | 5737734 | B1 | | 6/2015 | |
| JP | 2016-37676 | A | | 3/2016 | |
| JP | 2016194182 | A | * | 11/2016 | D03D 27/08 |
| JP | 2017-042370 | A | | 3/2017 | |
| TW | 201418539 | A | | 5/2014 | |
| TW | I491773 | B | | 7/2015 | |
| TW | 201540888 | A | | 11/2015 | |
| TW | 201633983 | A | | 10/2016 | |
| WO | WO 2015/049887 | A1 | | 4/2015 | |
| WO | WO 2015/122025 | A1 | | 8/2015 | |
| WO | WO2019/130579 | A1 | | 7/2019 | |

OTHER PUBLICATIONS

"Twist Direction." SWICOFIL, Jun. 22, 2006, https://www.swicofil.com/commerce/basic-information/yarn-manual/twist-direction. (Year: 2006).*

"Profiles of 15 of the World's Major Plant and Animal Fibres." 15 Natural Fibres| International Year of Natural Fibres 2009, Aug. 24, 2016, https://www.fao.org/natural-fibres-2009/about/15-natural-fibres/en/#:~:text=Cotton%3A%20It's%20almost%20pure%20cellulose,from%2011%20to%2022%20microns. (Year: 2009).*

Hatch, Kathryn L. "Unit III: Yarn Structure and Performance." Textile Science, West Publishing Company, St. Paul, MN, 1993, pp. 272-273. (Year: 1993).*

Singh, Jitendra Pratap, and Swadesh Verma. "Woven Terry Fabrics—Manufacturing and Quality Management." The Textile Institute, Elsevier. Woodhead Publishing Series in Textiles vol. No. 184. 2017. p. 264, p. 270. (Year: 2017) https://app.knovel.com/web/view/khtml/show.v/rcid:kpWTFMQMOF/cid:kt0114K4F4/viewerType:khtml/root_slug:woven-terry-fabrics-manufacturing/url_slug:front-matter?&page=1&view=collapsed&zoom=1 (Year: 2017).*

"Yarn Numbering Systems." SWICOFIL, Apr. 1, 2019. https://www.swicofil.com/commerce/basic-information/yarn-manual/yarn-numbering-systems. (Year: 2019).*

Kiron, Mazharul Islam, and Mazharul Islam KironFounder & Editor of Textile Learner. He is a Textile Consultant. "Basic Concept of Yarn Count, Yarn Diameter and Yarn Composition." Textile Learner, Dec. 4, 2021, https://textilelearner.net/yarn-count-diameter-and-composition/ (Year: 2021).*

"Yarn Conversion Calculator." Service Thread. Aug. 19, 2023. servicethread.com/tools (Year: 2023).*

"Conversion-Calculator for Measurements Units." Convert-measurement-units.com. Aug. 19, 2023. https://www.convert-measurement-units.com/convert+English+cotton+count+to+Tex.php (Year: 2023).*

International Search Report (with English translation) and Written Opinion mailed on Mar. 20, 2018 for International Patent Application No. PCT/JP2017/047354, 9 pages.

(56) References Cited

OTHER PUBLICATIONS

Taiwanese Office Action issued on Jan. 29, 2019 for Taiwanese Application No. 107144288, total 3 pages.
JPO Japanese Notice of Allowance issued on Jan. 9, 2019 for Japanese Application No. 2018-557059, total 3 pages.
CNIPA, Chinese Office Action (with translation) issued on Feb. 3, 2021 in Chinese Application No. 201780097940.9, 19 Pages.
EESR/EPO, The Extended European Search Report issued on Mar. 29, 2021 in European Patent Application No. 17936494.8, 9 pages with translation.

* cited by examiner general example

FIG. 15

TWISTED YARN

| | TWISTING COEFFICIENT OF PILE YARN | YARN COUNT OF PILE YARN (ENGLISH YARN COUNT) | DIAMETER OF PILE YARN D (mm) | REED DENSITY (dents/inch) | NUMBER OF PILE YARNS DRAWN THROUGH EACH DENT OF REED | PILE YARN DENSITY (yarns/inch) | GAP L BETWEEN PILE YARNS (mm) | NUMBER OF PICKS | NUMBER OF WEFT YARNS =NUMBER OF WEFT YARNS DRAWN ACROSS WARP YARNS (yarns/inch) | PILE MAGNIFICATION (times) | PILE HEIGHT H (mm) | H/D RATIO (times) | H/L RATIO (times) | PILE RETAINING PERFORMANCE (mN) EVALUATED BY JIS L 1075 B METHOD | FLUFF COMING OUT RATIO (10%) | YARN COUNT OF WARP YARN (ENGLISH YARN COUNT) | YARN COUNT OF WEFT YARN (ENGLISH YARN COUNT) |
|---|---|---|---|---|---|---|---|---|---|---|---|---|---|---|---|---|---|
| EMBODIMENT 1 | 4 | 60/1 | 0.12 | 47 | 2yarns | 94 | 0.25 | 3 | 52 | 8.6 | 6.3 | 51 | 25 | 4000 | - | 60/2 | 30/1 |
| EMBODIMENT 2 | 2.6 | 100/1 | 0.10 | 47 | 3yarns | 141 | 0.25 | 4 | 52 | 7.7 | 7.5 | 78 | 30 | 3900 | - | 60/2 | 30/1 |
| EMBODIMENT 3 | 2.8 | 100/1 | 0.10 | 47 | 2yarns | 94 | 0.35 | 4 | 52 | 7.7 | 7.5 | 78 | 22 | 3700 | - | 60/2 | 30/1 |
| | | | | | | | | | | | | | | | | | |
| COMPARATIVE EXAMPLE 1 | 4 | 40/1 | 0.15 | 34 | 2yarns | 68 | 0.44 | 3 | 50 | 6.1 | 6.2 | 40 | 14 | 1640 | - | 40/2 | 20/1 |
| COMPARATIVE EXAMPLE 2 | 2 | 30/2 | 0.25 | 34 | 1yarn | 34 | 0.50 | 5 | 60 | 7.4 | 7.8 | 31 | 16 | 1300 | - | 40/2 | 30/1 |
| COMPARATIVE EXAMPLE 3 | 3.6 | 20/1 | 0.22 | 34 | 1yarn | 34 | 0.50 | 3 | 43 | 6.1 | 5.5 | 24 | 10 | 1600 | - | 40/2 | 20/1 |
| COMPARATIVE EXAMPLE 4 | 4 | 20/1 | 0.22 | 34 | 1yarn | 34 | 0.53 | 3 | 43 | 6.5 | 6.7 | 31 | 13 | 1400 | - | 40/2 | 20/1 |
| COMPARATIVE EXAMPLE 5 | 4 | 40/1 | 0.18 | 36 | 1yarn | 36 | 0.58 | 3 | 40 | 6.1 | 7.7 | 44 | 15 | 2200 | - | 40/2 | 30/1 |
| COMPARATIVE EXAMPLE 6 | 2 | 30/2 | 0.25 | 32 | 1yarn | 32 | 0.54 | 5 | 50 | 6.8 | 8.7 | 35 | 16 | 1700 | - | 30/2 | 20/1 |
| COMPARATIVE EXAMPLE 7 | 3.8 | 16/1 | 0.23 | 32 | 1yarn | 32 | 0.56 | 3 | 43 | 6.1 | 6.2 | 27 | 11 | 1600 | - | 30/2 | 20/1 |
| COMPARATIVE EXAMPLE 8 | 3.8 | 16/1 | 0.23 | 30.5 | 1yarn | 30.5 | 0.60 | 3 | 50 | 6.6 | 8.6 | 38 | 14 | 1300 | - | 30/2 | 20/1 |
| COMPARATIVE EXAMPLE 9 | 4 | 40/1 | 0.15 | 29 | 1yarn | 29 | 0.72 | 3 | 50 | 7.4 | 5.6 | 37 | 8 | 500 | - | 20/1 | 30/1 |

FIG. 18

NON-TWISTED YARN

| | TWISTING COEFFICIENT OF PILE YARN | YARN COUNT OF PILE YARN (ENGLISH YARN COUNT) | DIAMETER OF PILE YARN D (mm) | REED DENSITY (dents/inch) | NUMBER OF PILE YARNS DRAWN THROUGH EACH DENT OF REED | PILE YARN DENSITY (yarns/inch) | GAP L BETWEEN PILE YARNS (mm) | NUMBER OF PICKS | NUMBER OF WEFT YARNS = NUMBER OF WEFT YARNS DRAWN ACROSS WARP YARNS (yarns/inch) | PILE MAGNIFICATION (times) | PILE HEIGHT H (mm) | H/D RATIO (times) | H/L RATIO (times) | PILE RETAINING PERFORMANCE (mN) EVALUATED BY JIS L 1076 B METHOD | FLUFF COMING OUT RATIO (%) | YARN COUNT OF WARP YARN (ENGLISH YARN COUNT) | YARN COUNT OF WEFT YARN (ENGLISH YARN COUNT) |
|---|---|---|---|---|---|---|---|---|---|---|---|---|---|---|---|---|---|
| EMBODIMENT 4 | 4 | 60/1PVA | 0.12 | 47 | 1yarn | 47 | 0.42 | 5 | 71 | 8.5 | 7.6 | 61 | 18 | 900 | 0.08 | 60/2 | 30/1 |
| EMBODIMENT 5 | 4 | 60/1PVA | 0.12 | 47 | 1yarn | 47 | 0.42 | 3 | 70 | 9.3 | 6.4 | 51 | 15 | 850 | 0.03 | 60/2 | 30/1 |
| COMPARATIVE EXAMPLE 10 | 4 | 20/1PVA | 0.22 | 34 | 1yarn | 34 | 0.53 | 3 | 50 | 6.5 | 5.0 | 23 | 9 | UN-MEASURABLE | 0.15 | 40/2 | 20/1 |
| COMPARATIVE EXAMPLE 11 | 4 | 30/1PVA | 0.18 | 34 | 1yarn | 34 | 0.59 | 3 | 45 | 8 | 6.8 | 38 | 11 | 430 | 0.24 | 40/2 | 20/1 |
| COMPARATIVE EXAMPLE 12 | 4 | 30/1PVA | 0.18 | 30.5 | 1yarn | 30.5 | 0.66 | 3 | 48 | 7.73 | 6.1 | 35 | 9 | UN-MEASURABLE | 0.32 | 40/2 | 20/1 |
| COMPARATIVE EXAMPLE 13 | 4 | 60/1PVA | 0.12 | 32 | 1yarn | 32 | 0.67 | 3 | 55 | 9.3 | 6.4 | 51 | 10 | 370 | 0.04 | 40/2 | 20/1 |

SOFT TWIST YARN

| | TWISTING COEFFICIENT OF PILE YARN | YARN COUNT OF PILE YARN (ENGLISH YARN COUNT) | DIAMETER OF PILE YARN D (mm) | REED DENSITY (dents/inch) | NUMBER OF PILE YARNS DRAWN THROUGH EACH DENT OF REED | PILE YARN DENSITY (yarns/inch) | GAP L BETWEEN PILE YARNS (mm) | NUMBER OF PICKS | NUMBER OF WEFT YARNS = NUMBER OF WEFT YARNS DRAWN ACROSS WARP YARNS (yarns/inch) | PILE MAGNIFICATION (times) | PILE HEIGHT H (mm) | H/D RATIO (times) | H/L RATIO (times) | PILE RETAINING PERFORMANCE (mN) EVALUATED BY JIS L 1076 B METHOD | FLUFF COMING OUT RATIO (%) | YARN COUNT OF WARP YARN (ENGLISH YARN COUNT) | YARN COUNT OF WEFT YARN (ENGLISH YARN COUNT) |
|---|---|---|---|---|---|---|---|---|---|---|---|---|---|---|---|---|---|
| EMBODIMENT 6 | 2.8 | 60/1 | 0.12 | 47 | 2yarns | 94 | 0.25 | 3 | 52 | 8.6 | 6.3 | 51 | 25 | 5300 | | 60/2 | 30/1 |
| EMBODIMENT 7 | 2.8 | 80/1 | 0.11 | 47 | 2yarns | 94 | 0.32 | 4 | 52 | 7.7 | 7.5 | 69 | 23 | 3700 | | 60/2 | 30/1 |
| COMPARATIVE EXAMPLE 14 | 3.3 | 40/1 | 0.15 | 30 | 2yarns | 60 | 0.54 | 3 | 44 | 5.3 | 4.6 | 30 | 8 | 1900 | | 20/1 | 20/1 |

PILE FABRIC

RELATED APPLICATIONS

This application is the U.S. National Phase of and claims priority to International Patent Application No. PCT/JP2017/047354, International Filing Date Dec. 28, 2017, entitled Pile Fabric, which is incorporated herein by reference in its entirety.

TECHNICAL FIELD

The present invention relates to a pile fabric having excellent durability (pile retention property or/and fluff coming out suppression property) in comparison with the conventional products.

BACKGROUND ART

The pile fabric is widely used nowadays. Towel cloth (pile fabric) is used in fields of a wide range such as towels, bath towels, gowns such as towel-made yukata, and, in addition, sheets.

The pile fabric has a base weave construction formed of warp yarns and weft yarns and loop piles formed of pile yarns.

With the loop piles, the pile fabric has improved water absorbency, hygroscopicity, and heat-retaining property in comparison with those of a plain-woven fabric. Further, the loops flex when they touch skin, which provides a soft touch feeling to the skin.

Generally, in the business field of towel, a bulky towel tends to be preferred because it gives a high-quality feeling. The bulkiness improves as thicker yarns are used. As a result, a person skilled in the art is interested in how to effectively use yarns having a thick count. In the actual transaction condition of towels, a towel market price tends to be decided based on the weight.

Many of the towels in the market use a twisted cotton yarn having an English yarn count of a range between 10 and 30 (e.g., 20 count yarns) for pile yarns (Patent Literature 1).

As described above, the pile fabric has an excellent soft touch feeling better than the plain-woven fabric. Now, more soft touch feeling is demanded.

There are two ways for obtaining more soft touch feeling for pile fabric. One is to use a non-twisted yarn (or soft twist yarn) for pile yarn (Patent Literature 2). The other is to use a fine count yarn for pile yarn.

A twisted yarn is formed by twisting short fibers made of, for example, raw cotton. On the other hand, a non-twisted yarn is formed by untwisting a twisted yarn to put the twisted yarn into a non-twisted state.

A towel using a non-twisted yarn for piles swells softly and holds a large amount of air between fibers. As a result, the towel having non-twisted yarn-made piles, in comparison with the general towels having twisted yarn-made piles, is featured in having a feel of soft touch and being light though it looks bulky. The towel having non-twisted yarn-made piles is featured in having a good water absorbency because it has many gaps between fibers and water is absorbed therethrough. The towel having non-twisted yarn-made piles also has a good heat-retaining property.

On the other hand, the non-twisted yarn has such a technical problem that bundling among the fibers is poor, and thus fluff comes out. When the fluff comes out, properties of the non-twisted yarn get lost. Further, the came out fluff clings to skin to make its consumer feel displeased.

For preventing the fluff coming out, loop piles are woven shorter and/or a front surface is covered with fine yarns. A feel of soft touch, however, is lost by such methods.

Further, when the towel cloth is applied to clothes, since the clothes always contact the skin, the fluff clings to the skin if it comes out. As a result, the fluff coming out becomes conspicuous. Further, the fluff coming out can make its consumer feel unpleased.

Now, a method of using a fine count yarn for a pile yarn will be described below. When a fine count yarn is used for pile yarn, the rigidity of piles becomes low to give a soft touch feeling. Here, the use of the piles formed of fine count yarn lowers the water absorbency and the other properties. Therefore, the piles are formed densely in order to keep the water absorbency and the other properties. Also, as the piles are made higher (longer), the rigidity of piles becomes lower, and thus the piles become softer.

On the other hand, when a fine count yarns are used for pile yarn, since a contact area between the pile yarn and the base weave construction decreases, the friction resistance decreases to make a tendency of coming out of pile yarn stronger.

As a loop pile becomes longer, a ring formed thereby become larger to cause a tendency of hooking of pile yarn when using and washing thereof. When contacting with a projection and the like and being applied with a strong friction, the pile yarn come out. Further, since an area where one loop pile receives friction becomes larger, the pile yarn is strongly adversely affected by a force applied form the outside when used and washed, resulting in inviting easy coming out of the pile yarn.

CITATION LIST

Patent Literature

[Patent Literature 1] JP 2017-042370A
[Patent Literature 2] JP 2000-079072A

SUMMARY OF INVENTION

Technical Problem

As described above, both the method of using a non-twisted yarn for pile yarn and the method of using a fine count yarn for pile yarn can provide the soft touch feeling.

The method of using a non-twisted yarn for pile yarn has a technical problem in fluff coming out. The method of using a fine count yarn for pile yarn has a technical problem in coming out of pile yarn.

More specifically, it is hard to achieve both the soft touch feeling and the durability (pile retention property or/and fluff coming out suppression property).

The present invention was made to solve the above described technical problems. A purpose of the present invention is to provide pile fabric capable of giving a soft touch feeling of a level equivalent to that given by the method of using a non-twisted yarn for pile yarn and the method of using a fine count yarn for pile yarn as well as to provide pile fabric having an excellent durability (pile retention property or/and fluff coming out suppression property).

Solution to Problem

To solve the above described technical problems, the pile fabric of the present invention includes a base weave construction formed of warp yarns and weft yarns and loop piles formed of pile yarns. The loop pile has a height 40 times or greater than a diameter of the pile yarn. The pile yarn is a twisted yarn having a twisting coefficient of 2.0 or greater.

With the above described structure, a snarl occurs on a loop pile.

To solve the above described technical problems, the pile fabric of the present invention includes a single layer base weave construction formed of warp yarns and weft yarns and loop piles formed from pile yarns by weaving the pile yarns and the weft yarns. Each of the loop piles has a standup portion and a return portion. Each of the loop pile yarn is twisted in a pile. When the standup portion and the returning portion intersect to form an annular shape with an intersection point, a snarl is formed from the intersection point and the annular shape. The loop pile has a height 40 times or greater than a diameter of the pile yarn, and the height of the loop pile is greater than 5 mm. The pile yarn is a non-twisted yarn or a soft twist yarn.

With the above described structure, a snarl occurs on a loop pile made of a non-twisted yarn or a loop pile made of a soft twist yarn.

Preferably, a plurality of the pile yarns is arranged in parallel with the warp yarns. A gap between the neighboring pile yarns is not greater than 0.5 mm.

With the above described structure, the snarls on the neighboring loop piles entwine together.

Preferably, the loop piles have snarls. The snarls on the neighboring loop piles entwine together.

With the above described structure, the pile retention property improves remarkably. In a case of a non-twisted yarn-made pile, fluff coming out can be suppressed.

Preferably, the pile yarn has an English yarn count of a range between 50 and 120.

With the above described structure, a pile height can be put in a predetermined range.

Preferably, a plurality of the pile yarns is arranged between the neighboring warp yarns.

With the above described structure, the snarls on the neighboring loop piles entwine together for sure.

To solve the above described technical problems, the pile fabric of the present invention has a base weave construction formed of warp yarns and weft yarns and loop piles formed of pile yarns. The loop piles have snarls and the snarls on the neighboring loop piles entwine together.

With the above described structure, the pile retention property improves dramatically. In a case of a non-twisted yarn-made pile, fluff coming out is suppressed.

To solve the above described technical problems, in the pile fabric manufacturing method of the present invention, the plurality of the pile yarns arranged between the neighboring warp yarns are put into (drawn through) the same reed mark of the reed for weaving. Snarls are formed after weaving, and the snarls on the neighboring loop piles entwine together.

To solve the above described technical problems, in the pile fabric manufacturing method of the present invention, in a case where the pile yarn is a non-twisted yarn or a soft twist yarn, a water-soluble yarn is wound to form a conjugated yarn that is used as the pile yarn, in a direction reverse to a twisting direction of a water-insoluble twisted yarn. The water-insoluble twisted yarn is a twisted yarn having a twisting coefficient of 2.0 or greater. The conjugated yarn is woven to form a loop pile, and the water-soluble yarn is removed thereafter to form a pile yarn.

Advantageous Effect of Invention

In the pile fabric of the present invention, in a case where a twisted yarn is used for pile yarn, the soft touch feeling can be provided as well as the pile retention property improves.

In the pile fabric of the present invention, in a case where a non-twisted yarn (or a soft twist yarn) is used for pile yarn, the soft touch feeling that is the characteristic of non-twisted yarn (or soft twist yarn) can be provided as well as the pile retention property improves and the fluff coming out is suppressed.

BRIEF DESCRIPTION OF DRAWINGS

FIG. 15 is a table showing measurement results of Embodiments and Comparative Examples (twisted yarn).

FIG. 18 is a table showing measurement results of Embodiments and Comparative Examples (non-twisted yarn; soft twist yarn).

DESCRIPTION OF EMBODIMENTS

~Effect of Snarl~

If snarls are formed on piles, in a case where a force for pulling out the neighboring piles is applied, the snarls serve to resist against the force at roots of the respective piles. Further, in a case where more than two snarls are formed on piles, even when one of the snarls comes to be unresistable against a strong force for pulling out the pile, a snarl next to the one will resist against the force.

When a snarl is formed on a pile, an opening area formed by the pile becomes small. This makes the pile hard to be hooked to a projection.

Owing to the above described mutual effect, the pile having a snarl contributes to improvement of the pile retention property.

~Condition Where Snarls Occur~

A Condition where a snarl surely occurs on a pile was studied. Especially, it is preferred that more than two snarls occur on one pile.

Here, one snarl is defined as follows. Namely, a loop-shaped pile yarn is twisted in a pile to be formed into a part constituted of a point of intersection and a roughly annular shape.

As a twisting coefficient of a twisted yarn is larger, a snarl occurs more. Further, as a pile yarn is thinner and as a pile is higher, a snarl occurs more.

Figure 1:
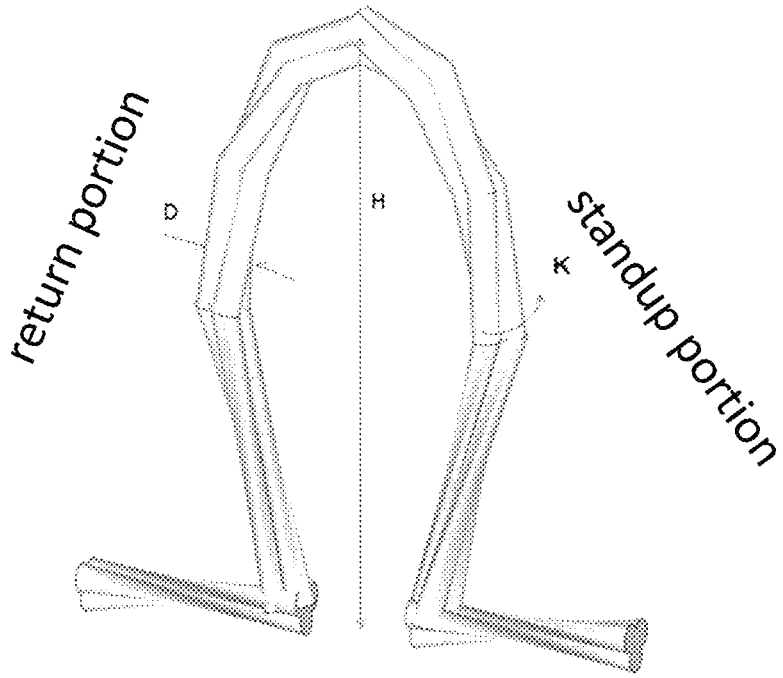
FIG. 1 shows a conditional elements regarding a snarl occurrence.

FIG. 1 shows a conditional element where a snarl occurs.

In a case where a twisting coefficient K of a pile yarn is 3.0 or greater, it is preferred that a ratio H/D of pile height to pile diameter is 40 times or greater.

In a case where a twisting coefficient K of a pile yarn is 2.5 or greater, it is preferred that a ratio H/D of pile height to pile diameter is 50 times or greater.

In a case where a twisting coefficient K of a pile yarn is 2.0 or greater, it is preferred that a ratio H/D of pile height to pile diameter is 70 times or greater.

Here, considering that use of a yarn having a yarn count thinner than an English yarn count of 120 is not practical or, generally, a towel having a pile height over 1.2 mm is not practical, an upper limit of H/D is 120.

To sum up the above conditions, such a twisted yarn is preferred that a ratio H/D of pile height to pile diameter is 40 times or greater and a twisting coefficient of a pile yarn is 2.0 or greater.

Further, such a twisted yarn is more preferred that a ratio H/D of pile height to pile diameter is 50 times or greater and a twisting coefficient of a pile yarn is 2.5 or greater.

Here in the specification of the present application, the expressions of "a pile length is long" and "a pile height is high" have the same meaning.

By the way, in a case of the general 3-pick structure, a pile yarn stands up from a position between weft yarns and returns from a position between weft yarns located two weft yarns away. A loop is formed in this manner. Generally, a length per pile means a length of a yarn from the beginning (a stand-up point) of a pile to the end (a returning point) of the pile.

Although "a pile length" and "a pile height" have the same meaning, "a pile height" is used here in order to avoid confusion between "a pile length" and "a pile length per pile."

Because a pile is formed into a loop shape, and a ring thereof swells largely and shrinks when a snarl is formed, and an actual measurement value of a pile height varies. On the other hand, a pile length per pile is decided by a reed loose at beating and can be exactly defined by the setting of a weaving machine. For this reason, a half-length of pile per pile is defined as a pile height for convenience sake.

Further, when the pile fabric is subjected to rubbing in a water flow tank or a special rotation brushing, a snarl occurs for sure. For obtaining a snarl, a single yarn is preferred for a pile yarn. It is also confirmed that a snarl occurs also on a double yarn.

~Yarn Count of Pile Yarn~

An English yarn count for pile yarn will be studied. As the pile yarn becomes thinner, a snarl occurs more.

As described above, because it is not practical to use a yarn having a yarn count thinner than a yarn count of 120, the yarn count of 120 is defined as the upper limit. More preferably, a yarn count of 100 is defined as the upper limit.

As the pile yarn becomes thicker, a snarl hardly occurs. In view of the practical use, in a case where an upper limit of the pile height is 12 mm and the H/D is 40 or greater, a snarl occurs even with a pile yarn having a yarn count of 20. In a case of the H/D of 50 or greater, a pile yarn having a yarn count of 30 or greater is preferred. In a case of the H/D of 70 or greater, a pile yarn having a yarn count of 40 or greater is preferred.

In a case where a lower limit of the yarn count is 50, a snarl occurs for sure. Taking the above into consideration, the pile yarn employed in the present Embodiment is a pile yarn having an English yarn count of a range between 50 and 120.

Figure 2:
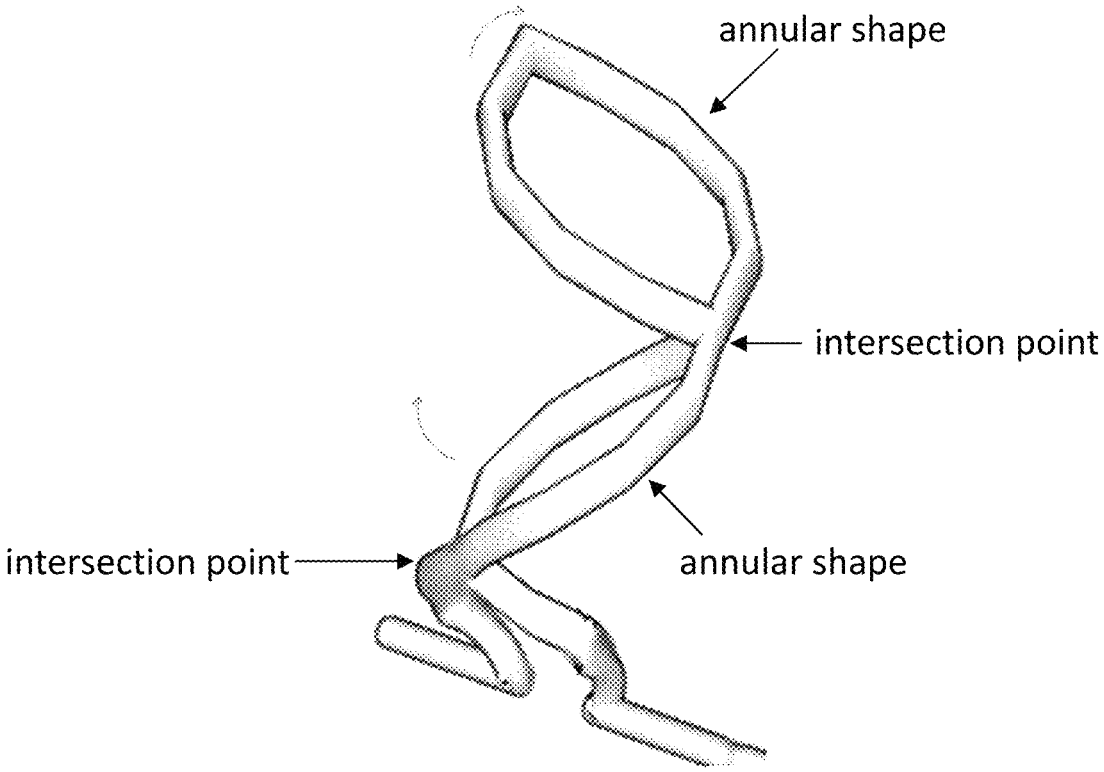
FIG. 2 shows a state where a snarl occurs.

FIG. 2 shows a state where a snarl occurs. When at least two snarls are formed on a pile, the pile retention property improves. Further, the snarls themselves rotate to entwine with snarls of the neighboring piles with ease.

~Condition Where Snarls Entwine Together~

In a case where not only a snarl is formed on each pile but also the snarls on the neighboring loop piles entwine together, resistant forces of the neighboring loop piles interact with each other to improve the pile retention property dramatically (see, the following Embodiments).

As a distance between the neighboring piles is shorter, snarls of the neighboring loop piles tend to entwine with ease.

Figure 3:
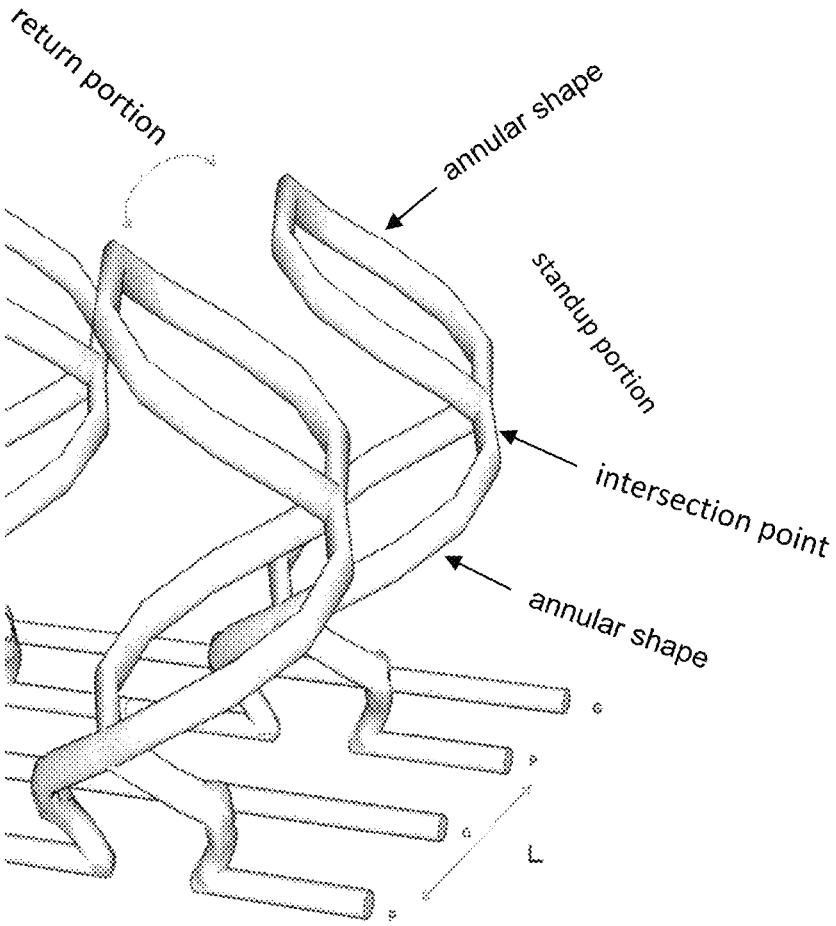
FIG. 3 shows a conditional element L regarding snarls entwine together occurrence.

FIG. 3 shows an element L which is a condition where snarls entwine together. A preferable distance L between the neighboring pile yarns is not greater than 0.5 mm.

The distance L between the neighboring piles is a space interval between piles.

Figure 4A:
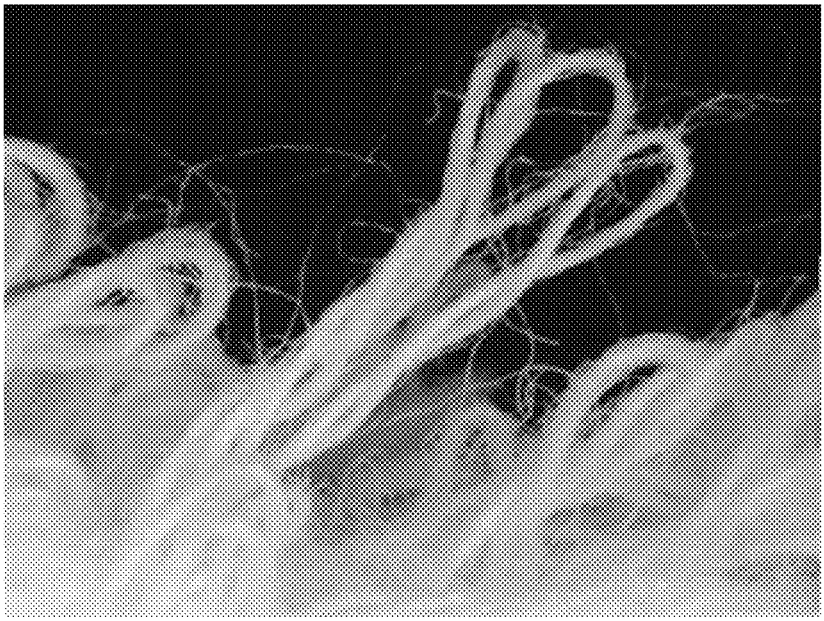
FIG. 4 shows a state where snarls entwine together.
Figure 4B:
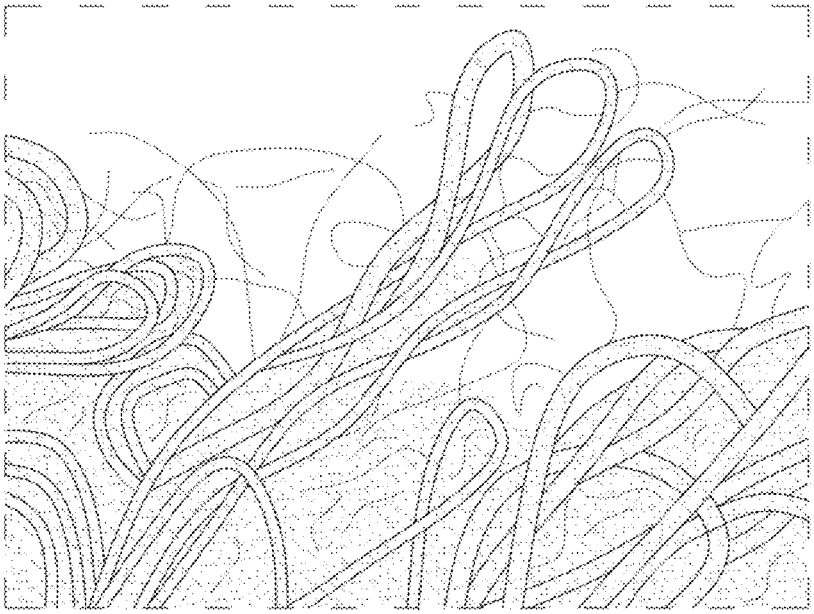

FIG. 4A shows a photograph of a state where snarls entwine together. FIG. 4B shows a line drawing of the photograph of FIG. 4A. In FIG. 4A and FIG. 4B, a plurality of snarls is formed on each of two piles, and the snarls on the neighboring loop piles entwine together to form an appearance of as if they are one pile.

Here, a strict definition of the distance L between neighboring piles slightly differs depending on details of each pile structure. Specific description is shown in FIG. 5 to FIG. 9.

Figure 5:
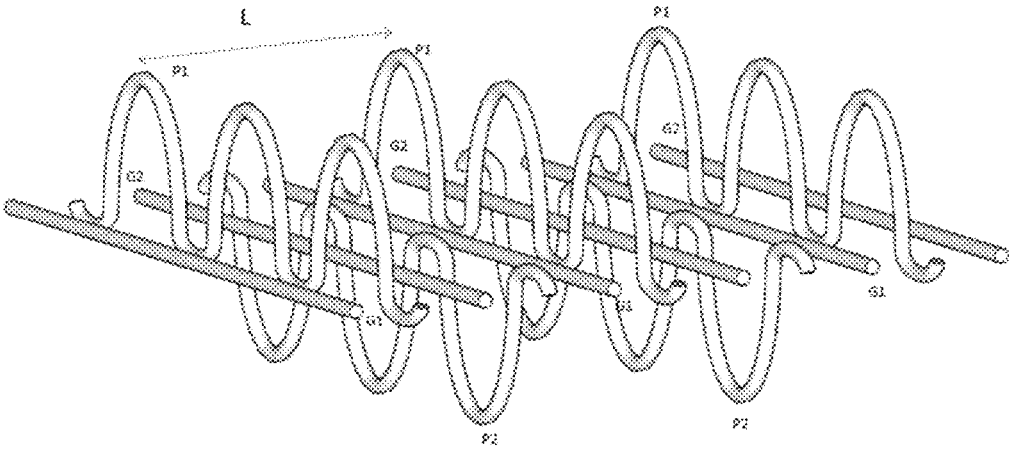
FIG. 5 shows a condition where snarls entwine together (Modification Example).

FIG. 5 shows a general pile structure. Warp yarns G1, G2 constituting a base weave construction are arranged alternately. A pile yarn P1 that forms a front pile is arranged between warp yarns G1, G2, and a pile yarn P2 that forms a back pile is arranged between warp yarn G2 and the neighboring warp yarn G1. As described above, the pile yarn P1 and the pile yarn P2 are arranged alternately.

A space interval between piles constituted of the neighboring pile yarns P1 is defined as L. More specifically, the space interval L is a value obtained by subtracting a length of pile diameter from an inverse number (distance between centers) of pile density.

Figure 6:
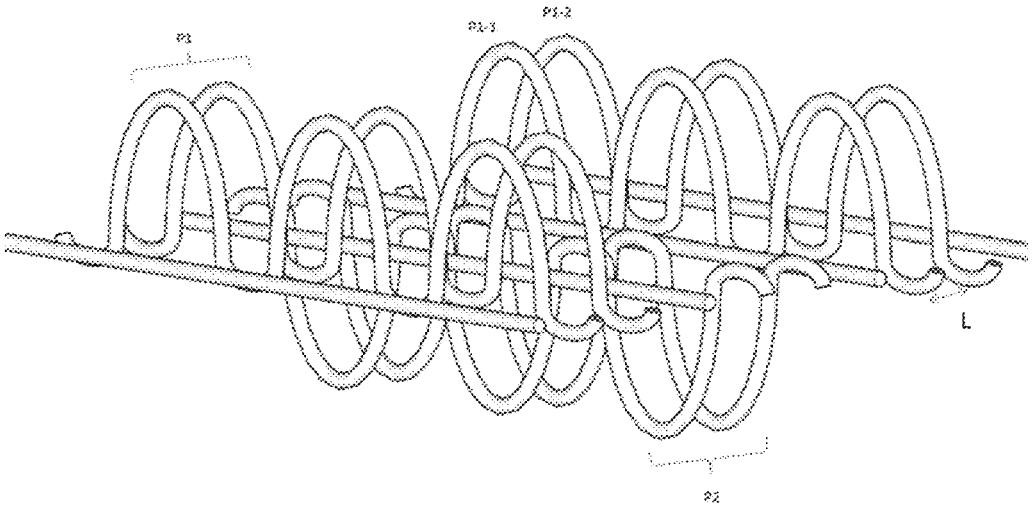
FIG. 6 shows a condition where snarls entwine together (Modification Example).

FIG. 6 shows a pile structure according to Modification Example. The warp yarns G1, G2 constituting a base weave construction are arranged alternately. Two pile yarns P1 (P1-1, P1-2) for forming a front pile are arranged between the warp yarns G1, G2, and two pile yarns P2 for forming a back pile are arranged between the warp yarn G2 and the neighboring warp yarn G1. In this manner, the pile yarns P1, P2 are arranged alternately.

A space interval between the neighboring pile yarns P1-1, P1-2 is defined as L.

Figure 7:
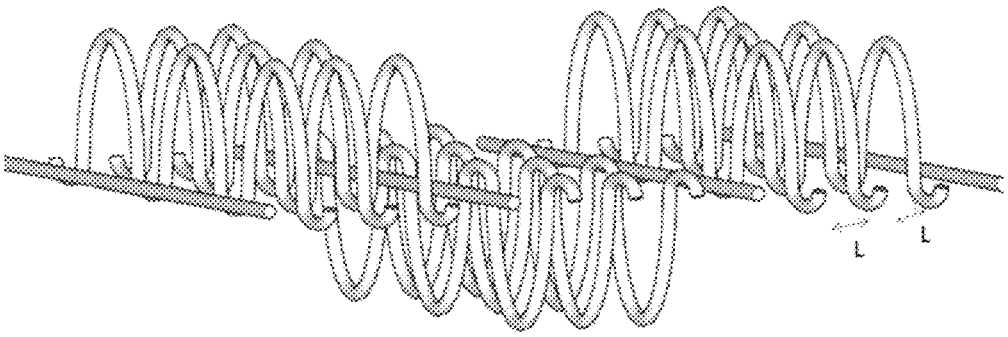
FIG. 7 shows a condition where snarls entwine together (Modification Example).

FIG. 7 shows Modification Example of FIG. 6. Where two pile yarns are arranged between the warp yarns G1, G2 in FIG. 6, three pile yarns are arranged therebetween in FIG. 7. A space interval between the neighboring pile yarns is defined as L.

Figure 8A:
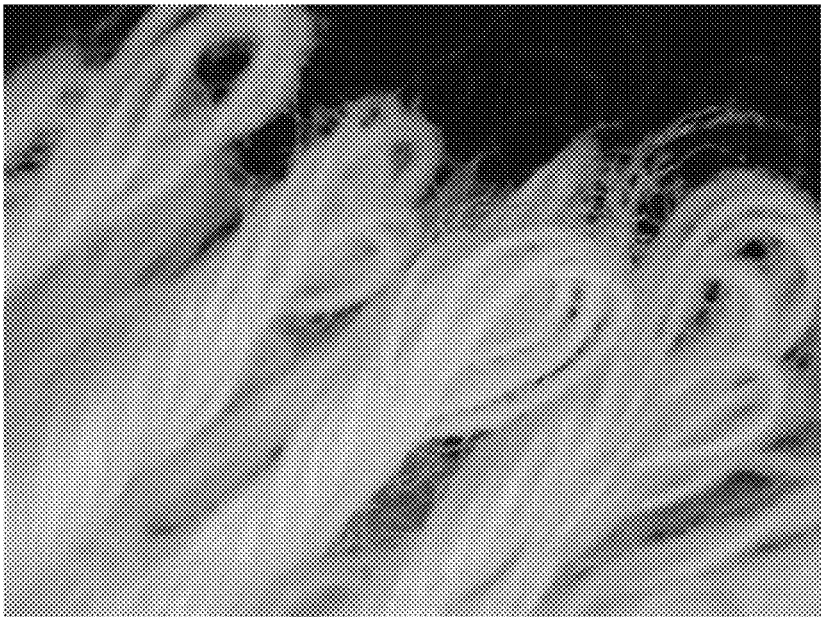
FIG. 8 shows a state where snarls entwine together (Modification Example).
Figure 8B:
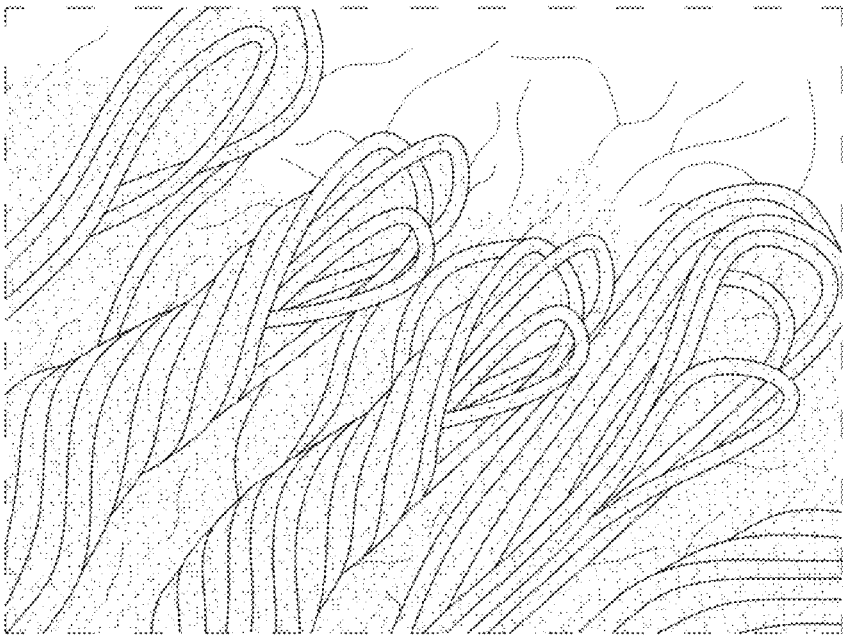

FIG. 8A shows a photograph of a state where snarls entwine together in the pile structure of FIG. 7. FIG. 8B shows a line drawing of the photograph of FIG. 8A. A plurality of snarls is formed on each of the three piles, and the snarls of the neighboring loop piles entwine together to form an appearance as if they are one pile.

Figure 9:
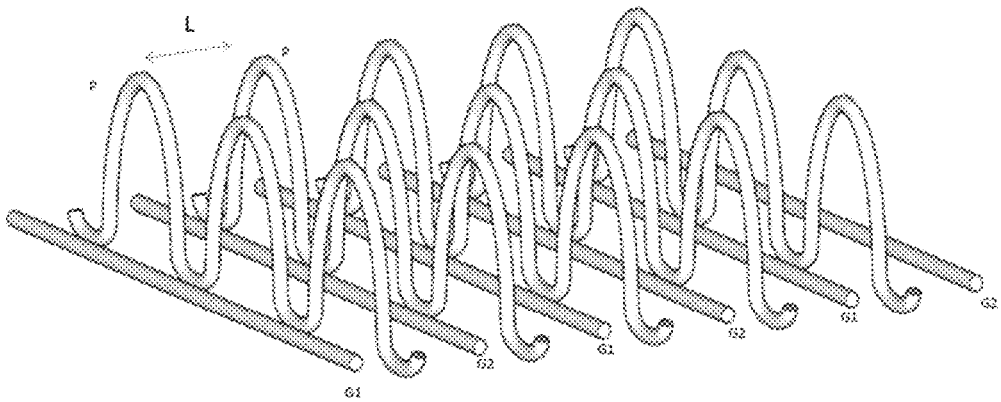
FIG. 9 shows a condition where snarls entwine together (Modification Example).

FIG. 9 shows a pile structure of a one side pile. The warp yarns G1, G2 constituting a base weave construction are arranged alternately. A pile yarn P forming the piles is arranged between the warp yarns G1, G2. A space interval between piles that is constituted of the neighboring pile yarns P is defined as L.

~Reeding~

In the general pile structure shown in FIG. 5, one pile yarn is drawn through each dent mark (also referred to as "dent") of the reed.

Figure 10:
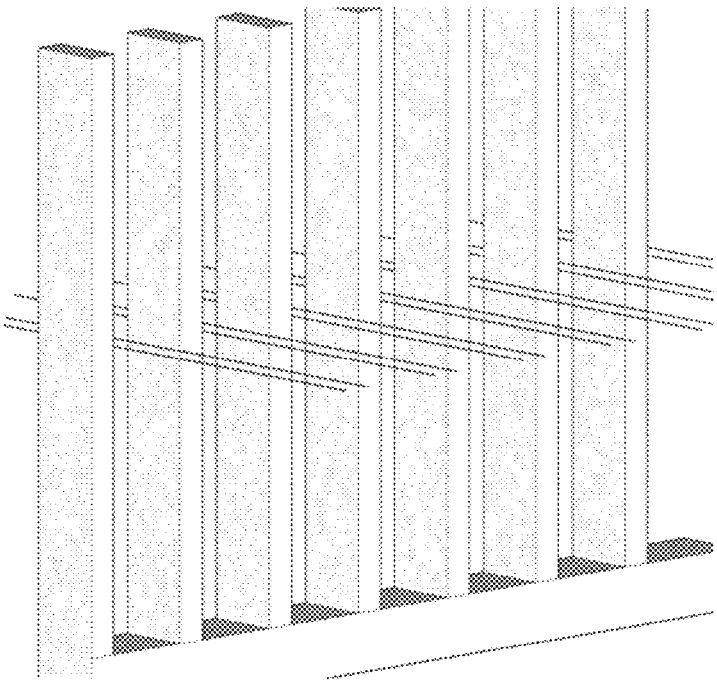
FIG. 10 shows a state where yarns are drawn through dents of the reed (Modification Example).

To the contrary, in the pile structure according to Modification Example as shown in FIG. 6, two pile yarns may be drawn through each dent mark (dent) of the reed. FIG. 10 shows a state where pile yarns are drawn through the reed.

Similarly, in the pile structure according to Modification Example as shown in FIG. 7, three pile yarns may be drawn through each dent mark (dent) of the reed.

When a plurality of pile yarns is drawn through the same dent mark of the reed, snarls are formed on the plurality of pile yarns for the same degree to allow easy entwinement of the snarls of the neighboring piles. In other words, the entwinement is ensured therebetween.

~Pick Structure~

In a case where a ground woven fabric part is added to the general 3-pick structure, since the added ground woven fabric part retains the pile yarns, the pile retention property improves more. The detailed explanation thereof will follow.

Figure 11:
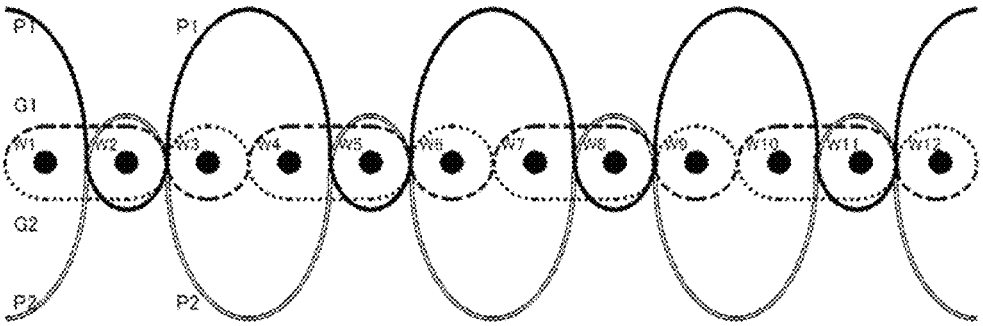
FIG. 11 shows the general 3-pick structure.

FIG. 11 shows the general 3-pick structure. A pile is formed by three picks. A pile stands up from a position between a weft yarn W2 and a weft yarn W3 and returns from a position between a weft yarn W4 and a weft yarn W5. Practically, also the weft yarn W5 contributes to the formation of the pile. But, since the weft yarn W5 also contributes to the structure of the neighboring pile, three picks corresponding to the weft yarns W2 to W4 are defined as the pile formation part. Similarly, three picks corresponding to the weft yarns W5 to W7 are defined as the neighboring pile forming part. Further similarly, three picks corresponding to weft yarns W8 to W10 are defined as the next neighboring pile forming part.

Figure 12:
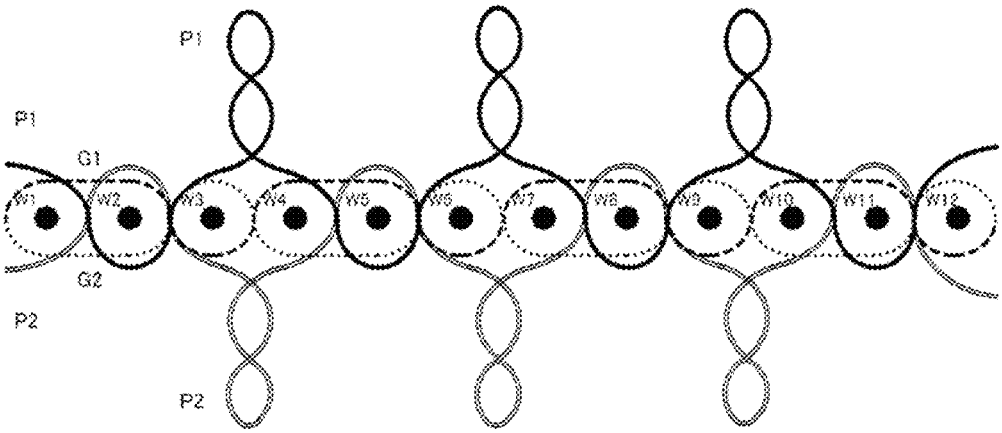
FIG. 12 shows a 3-pick structure of the present application.

FIG. 12 shows a state where the present invention is applied to the general 3-pick structure. More specifically, a pile has a snarl and the snarls of the neighboring loop piles entwine together.

Figure 13:
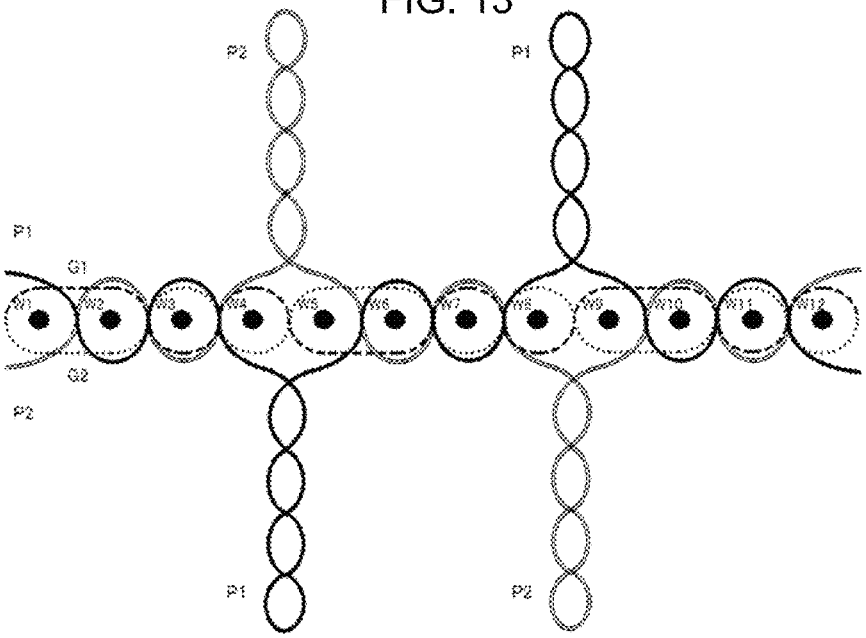
FIG. 13 shows a 4-pick structure of the present application.

FIG. 13 shows Modification Example in which the pick structure is modified to a 4-pick structure.

The Modification Example includes a pile forming part formed by three picks and a ground woven fabric part formed by one pick.

The number of picks is 4. More specifically, one repeat is constituted of 4 picks and the one repeat is repeated.

A pile stands up from a position between the weft yarn W3 and the weft yarn W4 and returns from a position between the weft yarn W5 and the weft yarn W6. Practically, the weft yarn W6 also contributes to the pile formation. But, for the sake of comparison with the 3-pick structure of the general conventional products, three picks corresponding to the weft yarns W3 to W5 are defined as the pile forming part. Similarly, three picks corresponding to the weft yarns W7 to W9 are defined as another pile forming part.

At picks corresponding to the weft yarns W2, W6, W10, the pile yarns cross the weft yarns without forming piles. These picks form the ground woven fabric part.

A pile formed on the pile forming part includes at least two snarls. FIG. 13 exemplifies 4 snarls.

In the 4-pick structure, upper piles and lower piles stand up alternately and are flipped between the front surface and the back surface. Therefore, it is applicable for fabrics in which design is not the major importance, e.g., plain towel.

Figure 14:
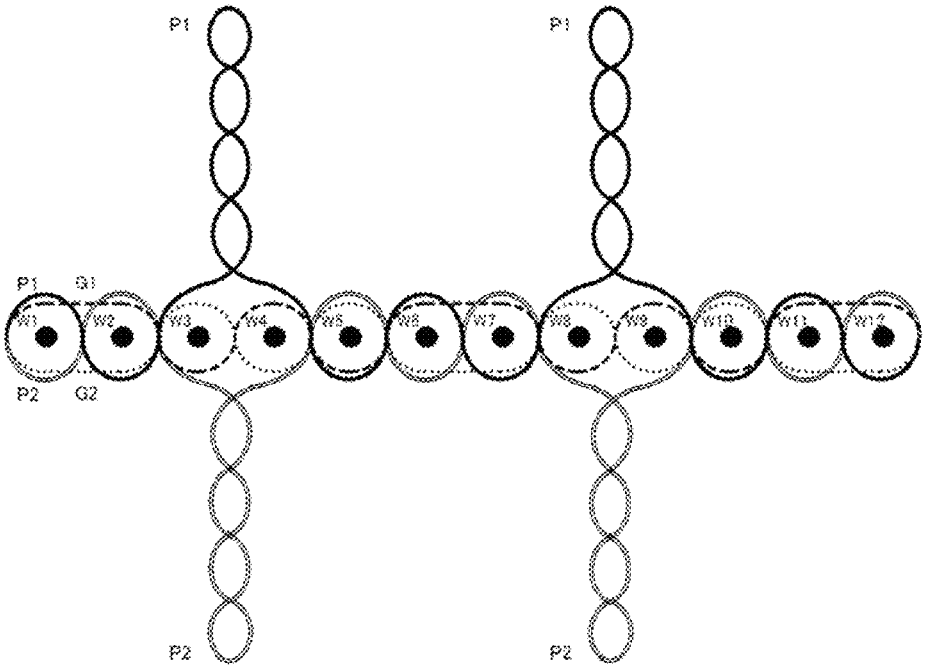
FIG. 14 shows a 5-pick structure of the present application.

FIG. 14 shows Modification Example in which the pick structure is modified to a 5-pick structure.

The Modification Example includes a pile forming part formed by three picks and a ground woven fabric part formed by two picks.

The number of picks is 5. More specifically, one repeat is constituted of five picks and the one repeat is repeated.

A pile stands up from a position between the weft yarn W2 and the weft yarn W3 and returns from a position between the weft yarn W4 and the weft yarn W5. Practically, also the weft yarn W5 contributes to the formation of the pile. But, for the sake of comparison with the 3-pick structure of the general conventional products (see below), three picks corresponding to the weft yarns W2 to W4 are defined as a pile forming part. Similarly, three picks corresponding to the weft yarns W7 to W9 are defined as the next pile forming part.

At two picks corresponding to the weft yarns W5 and W6, the pile yarns cross the weft yarns without forming piles. These two picks form the ground woven fabric part. Similarly, two picks corresponding to the weft yarns W10 and W11 are defined as another pile forming part.

A pile formed on the pile forming part includes at least two snarls. FIG. 14 exemplifies 4 snarls.

Embodiment (Twisted Yarn)

Embodiment 1

A single pile yarn (diameter D of 0.12 mm) having a twisting coefficient K of 4.0 and an English yarn count of 60 is employed.

Two pile yarns are drawn through each dent of the reed with a reed density of 47 dents/inch. As a result, a pile yarn density becomes 94 yarns/inch.

A 3-pick structure is employed. A weft yarn density of 52 yarns/inch is employed.

A pile having a pile magnification of 8.6 times and a pile height of 6.3 mm is formed. As a result, a ratio H/D of pile height to pile diameter becomes 51 times. Here, the pile magnification is a ratio of pile yarn length to warp yarn unit length.

A gap L between pile yarns becomes 0.25 mm and a ratio H/L of pile height to gap between pile yarns becomes 25 times.

A warp yarn made of a 60-count double yarn and a weft yarn made of a 30-count single yarn is employed for a base weave construction.

According to the structure of the present Embodiment, at least two snarls are formed on each pile, and the snarls of the neighboring piles entwine together.

The pile retaining performance of the present Embodiment was 4200 mN. The pile retention property was evaluated by JIS L 1075 B method.

Embodiment 2

A single pile yarn (diameter D of 0.10 mm) having a twisting coefficient K of 2.8 and an English yarn count of 100 is employed.

Three pile yarns are drawn through each dent of the reed with a reed density of 47 dents/inch. As a result, a pile yarn density becomes 141 yarns/inch.

A 4-pick structure is employed. A weft yarn density of 52 yarns/inch is employed.

A pile having a pile magnification of 7.7 times and a pile height of 7.5 mm is formed. As a result, a ratio H/D of pile height to pile diameter becomes 78 times.

A gap L between pile yarns becomes 0.25 mm, and a ratio H/L of pile height to gap between pile yarns becomes 30 times.

For a base weave construction, a double warp yarn having a yarn count of 60 and a single weft yarn having a yarn count of 30 are employed.

According to the structure of the present Embodiment, at least two snarls are formed on each pile, and the snarls on the neighboring piles entwine together.

The pile retaining performance of the present Embodiment was 3900 mN.

Embodiment 3

A single pile yarn (diameter D of 0.10 mm) having a twisting coefficient K of 2.8 and an English yarn count of 100 is employed.

Two pile yarns are drawn through each dent of the reed with a reed density of 47 dents/inch. As a result, a pile yarn density becomes 94 yarns/inch.

A 4-pick structure is employed. A weft yarn density of 52 yarns/inch is employed.

A pile having a pile magnification of 7.7 times and a pile height of 7.5 mm is formed. As a result, a ratio H/D of pile height to pile diameter becomes 78 times.

A gap L between pile yarns becomes 0.35 mm and a ratio H/L of pile height to gap between pile yarns becomes 22 times.

For a base weave construction, a double warp yarn having a yarn count of 60 and a single weft yarn having a yarn count of 30 are employed.

According to the structure of the present Embodiment, at least two snarls are formed on each pile, and the snarls on the neighboring piles entwine together.

The pile retaining performance of the present Embodiment was 3700 mN.

Comparative Example (Twisted Yarn)

Comparative Example 1

A single pile yarn (diameter D of 0.15 mm) having a twisting coefficient K of 4.0 and an English yarn count of 40 is employed.

Two pile yarns are drawn through each dent of the reed with a reed density of 34 dents/inch. As a result, a pile yarn density becomes 68 yarns/inch.

A 3-pick structure is employed. A weft yarn density of 50 yarns/inch is employed.

A pile having a pile magnification of 8.1 times and a pile height of 6.2 mm is formed. As a result, a ratio H/D of pile height to pile diameter becomes 40 times.

A gap L between pile yarns becomes 0.44 mm, and a ratio H/L of pile height to gap between pile yarns becomes 14 times.

For a base weave construction, a double warp yarn having a yarn count of 40 and a single weft yarn having a yarn count of 20 are employed.

According to the structure of the present Comparative Example, snarls are formed partially, but not sufficiently, on piles. Therefore, the snarls of the neighboring piles entwine only partially, i.e., unsatisfyingly.

The pile retaining performance of the present Comparative Example was 1843 mN.

Comparative Example 2

A double pile yarn (diameter D of 0.25 mm) having a twisting coefficient K of 2.0 and an English yarn count of 30 is employed.

One pile yarn is drawn through each dent of the reed with a reed density of 34 dents/inch. As a result, a pile yarn density becomes 34 yarns/inch.

A 5-pick structure is employed. A weft yarn density of 60 yarns/inch is employed.

A pile having a pile magnification of 7.4 times and a pile height of 7.8 mm is formed. As a result, a ratio H/D of pile height to pile diameter becomes 31 times.

A gap L between pile yarns becomes 0.50 mm, and a ratio H/L of pile height to gap between pile yarns becomes 16 times.

For a base weave construction, a double warp yarn having a yarn count of 40 and a single weft yarn having a yarn count of 30 are employed.

According to the structure of the present Comparative Example, no snarl is formed on piles. Therefore, the neighboring piles do not entwine.

The pile retaining performance of the present Comparative Example was 1308 mN.

Comparative Example 3

A single pile yarn (diameter D of 0.22 mm) having a twisting coefficient K of 3.6 and an English yarn count of 20 is employed.

One pile yarn is drawn through each dent of the reed with a reed density of 34 dents/inch. As a result, a pile yarn density becomes 34 yarns/inch.

A 3-pick structure is employed. A weft yarn density of 48 yarns/inch is employed.

A pile having a pile magnification of 8.1 times and a pile height of 5.3 mm is formed. As a result, a ratio H/D of pile height to pile diameter becomes 24 times.

A gap L between pile yarns becomes 0.53 mm, and a ratio H/L of pile height to gap between pile yarns becomes 10 times.

For a base weave construction, a double warp yarn having a yarn count of 40 and a single weft yarn having a yarn count of 20 are employed.

According to the structure of the present Comparative Example, no snarl is formed on piles. Therefore, the neighboring piles do not entwine.

The pile retaining performance of the present Comparative Example was 1600 mN.

Comparative Example 4

A single pile yarn (diameter D of 0.22 mm) having a twisting coefficient K of 4.0 and an English yarn count of 20 is employed.

One pile yarn is drawn through each dent of the reed with a reed density of 34 dents/inch. As a result, a pile yarn density becomes 34 yarns/inch.

A 3-pick structure is employed. A weft yarn density of 48 yarns/inch is employed.

A pile having a pile magnification of 8.5 times and a pile height of 6.7 mm is formed. As a result, a ratio H/D of pile height to pile diameter becomes 31 times.

A gap L between pile yarns becomes 0.53 mm, and a ratio H/L of pile height to gap between pile yarns becomes 13 times.

For a base weave construction, a double warp yarn having a yarn count of 40 and a single weft yarn having a yarn count of 20 are employed.

According to the structure of the present Comparative Example, no snarl is formed on piles. Therefore, the neighboring piles do not entwine.

The pile retaining performance of the present Comparative Example was 1489 mN.

Comparative Example 5

A single pile yarn (diameter D of 0.18 mm) having a twisting coefficient K of 4.0 and an English yarn count of 30 is employed.

One pile yarn is drawn through each dent of the reed with a reed density of 36 dents/inch. As a result, a pile yarn density becomes 36 yarns/inch.

A 3-pick structure is employed. A weft yarn density of 40 yarns/inch is employed.

A pile having a pile magnification of 8.1 times and a pile height of 7.7 mm is formed. As a result, a ratio H/D of pile height to pile diameter becomes 44 times.

A gap L between pile yarns becomes 0.53 mm, and a ratio H/L of pile height to gap between pile yarns becomes 15 times.

For a base weave construction, a double warp yarn having a yarn count of 40 and a single weft yarn having a yarn count of 30 are employed.

According to the structure of the present Comparative Example, snarls are formed on piles, which, however, does not contribute to entwinement of the neighboring piles.

The pile retaining performance of the present Comparative Example was 2200 mN.

Comparative Example 6

A double pile yarn (diameter D of 0.25 mm) having a twisting coefficient K of 2.0 and an English yarn count of 30 is employed.

One pile yarn is drawn through each dent of the reed with a reed density of 32 dents/inch. As a result, a pile yarn density becomes 32 yarns/inch.

A 5-pick structure is employed. A weft yarn density of 50 yarns/inch is employed.

A pile having a pile magnification of 6.9 times and a pile height of 8.7 mm is formed. As a result, a ratio H/D of pile height to pile diameter becomes 35 times.

A gap L between pile yarns becomes 0.54 mm, and a ratio H/L of pile height to gap between pile yarns becomes 16 times.

For a base weave construction, a double warp yarn having a yarn count of 30 and a single weft yarn having a yarn count of 20 are employed.

According to the structure of the present Comparative Example, no snarl is formed on piles. Therefore, the neighboring piles do not entwine.

The pile retaining performance of the present Comparative Example was 1700 mN.

Comparative Example 7

A single pile yarn (diameter D of 0.23 mm) having a twisting coefficient K of 3.3 and an English yarn count of 18 is employed.

One pile yarn is drawn through each dent of the reed with a reed density of 32 dents/inch. As a result, a pile yarn density becomes 32 yarns/inch.

A 3-pick structure is employed. A weft yarn density of 48 yarns/inch is employed.

A pile having a pile magnification of 8.1 times and a pile height of 6.2 mm is formed. As a result, a ratio H/D of pile height to pile diameter becomes 27 times.

A gap L between pile yarns becomes 0.56 mm, and a ratio H/L of pile height to gap between pile yarns becomes 11 times.

For a base weave construction, a double warp yarn having a yarn count of 30 and a single weft yarn having a yarn count of 20 are employed.

According to the structure of the present Comparative Example, no snarl is formed on piles. Therefore, the neighboring piles do not entwine.

The pile retaining performance of the present Comparative Example was 1600 mN.

Comparative Example 8

A single pile yarn (diameter D of 0.23 mm) having a twisting coefficient K of 3.3 and an English yarn count of 18 is employed.

One pile yarn is drawn through each dent of the reed with a reed density of 30.5 dents/inch. As a result, a pile yarn density becomes 30.5 yarns/inch.

A 5-pick structure is employed. A weft yarn density of 50 yarns/inch is employed.

A pile having a pile magnification of 6.8 times and a pile height of 8.6 mm is formed. As a result, a ratio H/D of pile height to pile diameter becomes 38 times.

A gap L between pile yarns becomes 0.60 mm, and a ratio H/L of pile height to gap between pile yarns becomes 14 times.

For a base weave construction, a double warp yarn having a yarn count of 30 and a single weft yarn having a yarn count of 20 are employed.

According to the structure of the present Comparative Example, no snarl is formed on piles. Therefore, the neighboring piles do not entwine.

The pile retaining performance of the present Comparative Example was 1800 mN.

Comparative Example 9

A single pile yarn (diameter D of 0.15 mm) having a twisting coefficient K of 4.0 and an English yarn count of 40 is employed.

One pile yarn is drawn through each dent of the reed with a reed density of 29 dents/inch. As a result, a pile yarn density becomes 29 yarns/inch.

A 3-pick structure is employed. A weft yarn density of 50 yarns/inch is employed.

A pile having a pile magnification of 7.4 times and a pile height of 5.6 mm is formed. As a result, a ratio H/D of pile height to pile diameter becomes 37 times.

A gap L between pile yarns becomes 0.72 mm, and a ratio H/L of pile height to gap between pile yarns becomes 8 times.

For a base weave construction, a single warp yarn having a yarn count of 20 and a single weft yarn having a yarn count of 30 are employed.

According to the structure of the present Comparative Example, no snarl is formed on piles. Therefore, the neighboring piles do not entwine.

The pile retaining performance of the present Comparative Example was 500 mN.

Consideration

FIG. 15 shows a list relating to Embodiments 1 to 3 and Comparative Examples 1 to 9.

In Embodiments 1 to 3, the ratios H/D of pile height to pile diameter are 40 times or greater, and the twisted pile yarns having twisting coefficients 2.0 or greater are employed. Further, the ratios H/D of pile height to pile diameter are 50 times or greater, and the twisted pile yarns having twisting coefficients of 2.5 or greater are employed. The gaps L between pile yarns are not greater than 0.5 mm. The ratios H/L of pile height to gap between pile yarns are 20 times or greater. The pile yarns having an English yarn count of a range between 50 and 120 are employed.

In Embodiments 1 to 3, at least two snarls are formed on each pile, and the snarls of the neighboring piles entwine together.

In Comparative Examples 2 to 4 and 6 to 9, the above described conditions are not satisfied, and thus no snarl is formed on piles. Therefore, the neighboring piles do not entwine.

In Comparative Example 1, the ratio H/D of pile height to pile diameter is 40 times, which is the lowest limit of the condition. Snarls are partially, but not sufficiently, formed on piles. Therefore, the snarls of the neighboring piles entwine only partially, i.e., unsatisfyingly.

In Comparative Example 5, snarls are formed on piles but, since the gap L between pile yarns is more than 0.5 mm, the neighboring piles do not entwine.

Detailed structures are different from one another in Embodiments and Comparative Examples. Therefore, it is hard to make a strict comparison therebetween. Where an average pile retaining performance is about 4000 mN in Embodiments 1 to 3, the pile retaining performances never be more than 1800 mN in Comparative Examples 2 to 4 and 6 to 9. In other words, the pile retaining performances of Embodiments of the present application are two times or greater than those of Comparative Examples. The pile retention property improves in Embodiments of the present application.

In Comparative Examples 1 and 5, snarls occur here and there, which provides a little improvement in pile retention property. The neighboring piles, however, do not entwine satisfactorily. More specifically, Comparative Examples 1 and 5 cannot provide the pile retaining performances of the same level as those of Embodiments of the present application.

~Application to Non-Twisted Yarn (or Soft Twist Yarn)~

Figure 16:
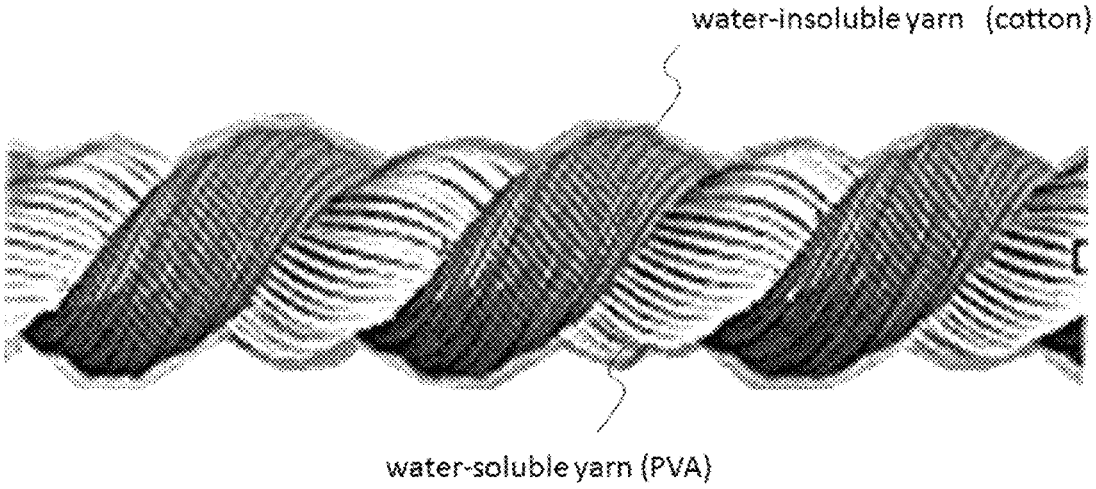
FIG. 16 schematically illustrates a conjugated yarn.

FIG. 16 schematically illustrates a conjugated yarn before it is made into a non-twisted yarn.

Where a twisted yarn is formed by twisting fibers of, for example, raw cotton, a non-twisted yarn is formed by untwisting the twisted yarn till it becomes an untwisted state. More specifically, a non-twisted yarn is formed in the following manner. After a water-soluble yarn (e.g., PVA) is wounded around a water-insoluble twisted yarn (e.g., cotton yarn) in a direction reverse to a twisting direction of the water-insoluble twisted yarn to thereby form a conjugated yarn, the water-soluble yarn is removed from the conjugated yarn.

For example, when a water-soluble yarn is twisted 100 times while a water-insoluble twisted yarn is twisted 100 times, a non-twisted yarn is formed. In this structure, a twisting coefficient K of the non-twisted yarn is 0.

On the other hand, when a water-soluble yarn is twisted 30 times while a water-insoluble twisted yarn is twisted 100 times, a soft twist yarn twisted by 70% after untwisting is formed.

When a water-soluble yarn is twisted 170 times while a water-insoluble twisted yarn is twisted 100 times, a soft twist yarn twisted by −70% after untwisting (twisted in a direction reverse to an original twisting direction of a cotton yarn) is formed.

In a case where a twisting coefficient of the water-insoluble twisted yarn is 2.0 or greater, the resulting yarn can be treated as well as the twisted yarn in the above described Embodiment. More specifically, weaving is performed in such a manner that loop piles are formed by a conjugated yarn.

A ratio H/D of pile height to pile diameter is 40 times or greater, and a water-insoluble twisted yarn having a twisting coefficient of 2.0 or greater is employed. Further, a ratio H/D of pile height to pile diameter is 50 times or greater, and a water-insoluble twisted yarn having a twisting coefficient of 2.5 or greater is employed. A gap L between pile yarns is not greater than 0.5 mm.

At least two snarls are formed on each pile, and the snarls on the neighboring piles entwine together.

After the formation of piles, the water-soluble yarn is removed from a conjugated yarn to make the pile yarn a non-twisted yarn (or soft twist yarn).

In a case where not only snarls are formed on each pile but also the snarls on the neighboring loop piles entwine together, fluff coming out can be suppressed in addition to the improvement of the pile retention property (see, the following Embodiments).

Embodiment (Non-Twisted Yarn)

Figure 17A:
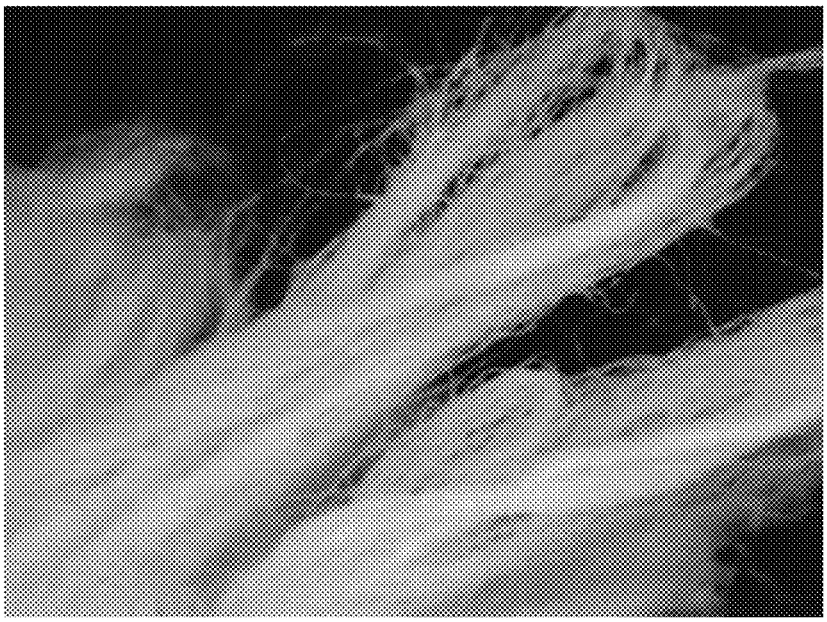
FIG. 17 shows a state where snarls entwine together (non-twisted yarn).
Figure 17B:
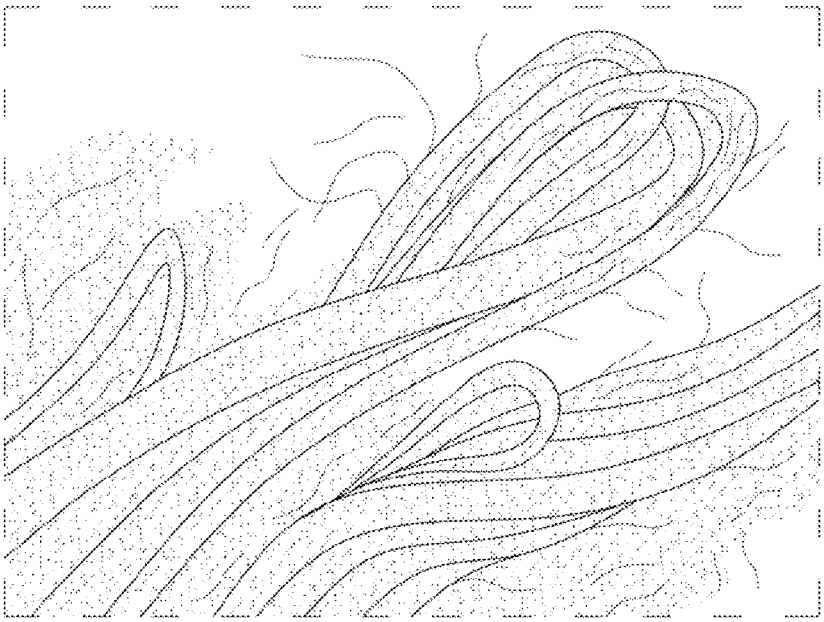

FIG. 17A shows a photograph of a state where at least two snarls are formed on non-twisted yarn-made piles to allow entwinement of the neighboring piles together via the snarls. FIG. 17B shows a line drawing of the photograph of FIG. 17A.

Embodiment 4

A water-insoluble single cotton yarn (diameter D of 0.12 mm) having a twisting coefficient K of 4.0 and an English yarn count of 60 is employed. A water-soluble yarn (PVA) is twisted in a direction reverse to the water-insoluble twisted yarn to the same degree, thereby forming a conjugated yarn. This conjugated yarn is used for a pile yarn.

One pile yarn is drawn through each dent of the reed with a reed density of 47 dents/inch. As a result, a pile yarn density becomes 47 yarns/inch.

A 5-pick structure is employed. A weft yarn density of 71 yarns/inch is employed.

A pile having a pile magnification of 8.5 times and a pile height of 7.6 mm is formed. As a result, a ratio H/D of pile height to pile diameter becomes 61 times. Here, the pile magnification is a ratio of pile yarn length to warp yarn unit length.

A gap L between pile yarns becomes 0.42 mm, and a ratio H/L of pile height to gap between pile yarns becomes 18 times.

For a base weave construction, a double warp yarn having a yarn count of 60 and a single weft yarn having a yarn count of 30 are employed.

According to the structure of the present Embodiment, at least two snarls are formed on each pile, and the snarls on the neighboring piles entwine together.

The water-soluble yarn is removed from the conjugated yarn to form a non-twisted yarn-made pile (having a twisting coefficient K of 0). Even when the water-soluble yarn is removed, at least two snarls are formed on each pile, and the snarls on the neighboring piles entwine together.

The pile retaining performance of the present Embodiment was 900 mN. The pile retention property was evaluated by means of JIS L 1075 B method.

A fluff coming out ratio of the present Embodiment was 0.08%. The fluff coming out ratio was evaluated by a test method conforming to the TRI method devised by Osaka Research Institute of Industrial Science and Technology. The fluff coming out ratio is represented by a ratio of a mass of fiber that comes out from products by washing to a mass of product before washing. This is generally employed as an index for evaluating the quality of towel.

Embodiment 5

A water-insoluble single cotton yarn (diameter D of 0.12 mm) having a twisting coefficient K of 4.0 and an English yarn count of 60 is employed. A water-soluble yarn (PVA) is twisted in a direction reverse to the water-insoluble twisted yarn to the same degree, thereby forming a conjugated yarn. This conjugated yarn is used for a pile yarn.

One pile yarn is drawn through each dent of the reed with a reed density of 47 dents/inch. As a result, a pile yarn density becomes 47 yarns/inch.

A 3-pick structure is employed. A weft yarn density of 70 yarns/inch is employed.

A pile having a pile magnification of 9.3 times and a pile height of 6.4 mm is formed. As a result, a ratio H/D of pile height to pile diameter becomes 51 times.

A gap L between pile yarns becomes 0.42 mm, and a ratio H/L of pile height to gap between pile yarns becomes 15 times.

For a base weave construction, a double warp yarn having a yarn count of 60 and a single weft yarn having a yarn count of 30 are employed.

According to the structure of the present Embodiment, at least two snarls are formed on each pile, and the snarls on the neighboring piles entwine together.

The water-soluble yarn is removed from the conjugated yarn to form a non-twisted yarn-made pile (having a twisting coefficient K of 0). Even when the water-soluble yarn is removed, at least two snarls are formed on each pile, and the snarls on the neighboring piles entwine together.

The pile retaining performance of the present Embodiment was 850 mN. A fluff coming out ratio of the present Embodiment was 0.03%.

Comparative Example (Non-Twisted Yarn)

Comparative Example 10

A water-insoluble single cotton yarn (diameter D of 0.22 mm) having a twisting coefficient K of 4.0 and an English yarn count of 20 is employed. A water-soluble yarn (PVA) is twisted in a direction reverse to the water-insoluble twisted yarn to the same degree, thereby forming a conjugated yarn. This conjugated yarn is used for a pile yarn.

One pile yarn is drawn through each dent of the reed with a reed density of 34 dents/inch. As a result, a pile yarn density becomes 34 yarns/inch.

A 3-pick structure is employed. A weft yarn density of 50 yarns/inch is employed.

A pile having a pile magnification of 6.5 times and a pile height of 5.0 mm is formed. As a result, a ratio H/D of pile height to pile diameter becomes 23 times.

A gap L between pile yarns becomes 0.53 mm, and a ratio H/L of pile height to gap between pile yarns becomes 9 times.

For a base weave construction, a double warp yarn having a yarn count of 40 and a single weft yarn having a yarn count of 20 are employed.

According to the structure of the present Comparative Example, no snarl is formed on piles. Therefore, the neighboring piles do not entwine.

The water-soluble yarn is removed from the conjugated yarn to form a non-twisted yarn-made pile (having a twisting coefficient K of 0). Even when the water-soluble yarn is removed, no snarl is formed on piles. Therefore, the neighboring piles do not entwine.

In the present Comparative Example, the pile yarn broke shortly, which disabled measurement of the pile retaining performance. A fluff coming out ratio of the present Comparative Example was 0.15%.

Comparative Example 11

A water-insoluble single cotton yarn (diameter D of 0.18 mm) having a twisting coefficient K of 4.0 and an English yarn count of 30 is employed. A water-soluble yarn (PVA) is twisted in a direction reverse to the water-insoluble twisted yarn to the same degree, thereby forming a conjugated yarn. This conjugated yarn is used for a pile yarn.

One pile yarn is drawn through each dent of the reed with a reed density of 34 dents/inch. As a result, a pile yarn density becomes 34 yarns/inch.

A 3-pick structure is employed. A weft yarn density of 45 yarns/inch is employed.

A pile having a pile magnification of 8.0 times and a pile height of 6.8 mm is formed. As a result, a ratio H/D of pile height to pile diameter becomes 39 times.

A gap L between pile yarns becomes 0.59 mm, and a ratio H/L of pile height to gap between pile yarns becomes 11 times.

For a base weave construction, a double warp yarn having a yarn count of 40 and a single weft yarn having a yarn count of 20 are employed.

According to the structure of the present Comparative Example, no snarl is formed on piles. Therefore, the neighboring piles do not entwine.

The water-soluble yarn is removed from the conjugated yarn to form a non-twisted yarn-made pile (having a twisting coefficient K of 0). Even when the water-soluble yarn is removed, no snarl is formed on piles. Therefore, the neighboring piles do not entwine.

The pile retaining performance of the present Comparative Example was 430 mN. A fluff coming out ratio of the present Comparative Example was 0.24%.

Comparative Example 12

A water-insoluble single cotton yarn (diameter D of 0.18 mm) having a twisting coefficient K of 4.0 and an English yarn count of 30 is employed. A water-soluble yarn (PVA) is twisted in a direction reverse to the water-insoluble twisted yarn to the same degree, thereby forming a conjugated yarn. This conjugated yarn is used for a pile yarn.

One pile yarn is drawn through each dent of the reed with a reed density of 30.5 dents/inch. As a result, a pile yarn density becomes 30.5 yarns/inch.

A 3-pick structure is employed. A weft yarn density of 48 yarns/inch is employed.

A pile having a pile magnification of 7.7 times and a pile height of 6.1 mm is formed. As a result, a ratio H/D of pile height to pile diameter becomes 35 times.

A gap L between pile yarns becomes 0.66 mm, and a ratio H/L of pile height to gap between pile yarns becomes 9 times.

For a base weave construction, a double warp yarn having a yarn count of 40 and a single weft yarn having a yarn count of 20 are employed.

According to the structure of the present Comparative Example, no snarl is formed on piles. Therefore, the neighboring piles do not entwine.

The water-soluble yarn is removed from the conjugated yarn to form a non-twisted yarn-made pile (having a twisting coefficient K of 0). Even when the water-soluble yarn is removed, no snarl is formed on piles. Therefore, the neighboring piles do not entwine.

In the present Comparative Example, the pile yarn broke shortly, which disabled measurement of the pile retaining performance. A fluff coming out ratio of the present Comparative Example was 0.32%.

Comparative Example 13

A water-insoluble single cotton yarn (diameter D of 0.12 mm) having a twisting coefficient K of 4.0 and an English yarn count of 60 is employed. A water-soluble yarn (PVA) is twisted in a direction reverse to the water-insoluble twisted yarn to the same degree, thereby forming a conjugated yarn. This conjugated yarn is used for a pile yarn.

One pile yarn is drawn through each dent of the reed with a reed density of 32 dents/inch. As a result, a pile yarn density becomes 32 yarns/inch.

A 3-pick structure is employed. A weft yarn density of 45 yarns/inch is employed.

A pile having a pile magnification of 9.3 times and a pile height of 6.4 mm is formed. As a result, a ratio H/D of pile height to pile diameter becomes 51 times.

A gap L between pile yarns becomes 0.67 mm, and a ratio H/L of pile height to gap between pile yarns becomes 10 times.

For a base weave construction, a double warp yarn having a yarn count of 40 and a single weft yarn having a yarn count of 20 are employed.

According to the structure of the present Comparative Example, snarls are formed on piles, which, however, does not contribute to entwinement of the neighboring piles.

The water-soluble yarn is removed from the conjugated yarn to form a non-twisted yarn-made pile (having a twisting coefficient K of 0). Even when the water-soluble yarn is removed, snarls are formed on piles, which, however, does not contribute to entwinement of the neighboring piles.

The pile retaining performance of the present Comparative Example was 370 mN. A fluff coming out ratio of the present Comparative Example was 0.04%.

Embodiment (Soft Twist Yarn)

Embodiment 6

A water-insoluble single cotton yarn (diameter D of 0.12 mm) having a twisting coefficient K of 4.0 and an English yarn count of 60 is employed. A water-soluble yarn (PVA) is twisted in a direction reverse to the water-insoluble twisted yarn by about 30%, thereby forming a conjugated yarn. This conjugated yarn is used for a pile yarn.

Two pile yarns are drawn through each dent of the reed with a reed density of 47 dents/inch. As a result, a pile yarn density becomes 94 yarns/inch.

A 3-pick structure is employed. A weft yarn density of 52 yarns/inch is employed.

A pile having a pile magnification of 8.6 times and a pile height of 6.3 mm is formed. As a result, a ratio H/D of pile height to pile diameter becomes 51 times. Here, the pile magnification is a ratio of pile yarn length to warp yarn unit length.

A gap L between pile yarns becomes 0.25 mm, and a ratio H/L of pile height to gap between pile yarns becomes 25 times.

For a base weave construction, a double warp yarn having a yarn count of 60 and a single weft yarn having a yarn count of 30 are employed.

According to the structure of the present Embodiment, at least two snarls are formed on each pile, and the snarls on the neighboring piles entwine together.

The water-soluble yarn is removed from the conjugated yarn to form a soft twist yarn-made pile (having a twisting coefficient K of 2.8). Even when the water-soluble yarn is removed, at least two snarls are formed on each pile, and the snarls on the neighboring piles entwine together.

The pile retaining performance of the present Embodiment was 5300 mN. The pile retention property was evaluated by means of JIS L 1075 B method.

Embodiment 7

A water-insoluble single cotton yarn (diameter D of 0.11 mm) having a twisting coefficient K of 4.0 and an English yarn count of 80 is employed. A water-soluble yarn (PVA) is twisted in a direction reverse to the water-insoluble twisted yarn by about 30%, thereby forming a conjugated yarn. This conjugated yarn is used for a pile yarn.

Two pile yarns are drawn through each dent of the reed with a reed density of 47 dents/inch. As a result, a pile yarn density becomes 94 yarns/inch/inch.

A 3-pick structure is employed. A weft yarn density of 52 yarns/inch is employed.

A pile having a pile magnification of 9.3 times and a pile height of 6.4 mm is formed. As a result, a ratio H/D of pile height to pile diameter becomes 69 times.

A gap L between pile yarns becomes 0.32 mm, and a ratio H/L of pile height to gap between pile yarns becomes 23 times.

For a base weave construction, a double warp yarn having a yarn count of 60 and a single weft yarn having a yarn count of 30 are employed.

According to the structure of the present Embodiment, at least two snarls are formed on each pile, and the snarls on the neighboring piles entwine together.

The water-soluble yarn is removed from the conjugated yarn to form a soft twist yarn-made pile (having a twisting coefficient K of 2.8). Even when the water-soluble yarn is removed, at least two snarls are formed on each pile, and the snarls on the neighboring piles entwine together.

The pile retaining performance of the present Embodiment was 3700 mN.

Comparative Example (Soft Twist Yarn)

Comparative Example 14

A water-insoluble single cotton yarn (diameter D of 0.15 mm) having a twisting coefficient K of 4.0 and an English yarn count of 40 is employed. A water-soluble yarn (PVA) is twisted in a direction reverse to the water-insoluble twisted yarn by about 18%, thereby forming a conjugated yarn. This conjugated yarn is used for a pile yarn.

Two pile yarns are drawn through each dent of the reed with a reed density of 30 dents/inch. As a result, a pile yarn density becomes 60 yarns/inch.

A3-pick structure is employed. A weft yarn density of 44 yarns/inch is employed.

A pile having a pile magnification of 5.3 times and a pile height of 4.6 mm is formed. As a result, a ratio H/D of pile height to pile diameter becomes 30 times.

A gap L between pile yarns becomes 0.54 mm, and a ratio H/L of pile height to gap between pile yarns becomes 8 times.

For a base weave construction, a single warp yarn having a yarn count of 20 and a single weft yarn having a yarn count of 20 are employed.

According to the structure of the present Comparative Example, no snarl is formed on piles. Therefore, the neighboring piles do not entwine.

The water-soluble yarn is removed from the conjugated yarn to form a soft twist yarn-made pile (having a twisting coefficient K of 3.3). Even when the water-soluble yarn is removed, no snarl is formed on piles. Therefore, the neighboring piles do not entwine.

The pile retaining performance of the present Comparative Example was 1900 mN.

Consideration

FIG. 18 shows a list relating to Embodiments 5 to 8 and Comparative Examples 10 to 14.

In Embodiments 4 and 5, the pile yarn is a non-twisted yarn. The non-twisted yarn is formed such that a water-soluble yarn is removed from a conjugated yarn that includes a water-insoluble twisted yarn having a twisting coefficient of 2.0 or greater. A ratio H/D of pile height to pile diameter is 40 times or greater. Further, a ratio H/D of pile height to pile diameter is 50 times or greater. A gap L between pile yarns is 0.5 mm or less. A ratio H/L of pile height to gap between pile yarns is 15 times or greater. The pile yarn has an English yarn count of a range between 50 and 120.

In Embodiments 4 and 5, at least two snarls are formed on each non-twisted yarn-made pile, and the snarls on the neighboring piles entwine together.

Comparative Examples 10 to 12 do not satisfy the above described conditions, and thus no snarl is formed on piles. Therefore, the neighboring piles do not entwine.

In Comparative Example 13, snarls are formed on piles. But the gap L between pile yarns is more than 0.5 mm. Therefore, the neighboring piles do not entwine.

Detailed structures are different from one another in Embodiments and Comparative Examples. Therefore, it is hard to make a strict comparison therebetween. Where an average pile retaining performance of Embodiments 4 and 5 is about 900 mN, the pile retaining performances never be more than 450 mN in Comparative Examples 10 to 13. In other words, the pile retaining performances of Embodiments of the present application are two times or greater than those of Comparative Examples. The pile retention property improves in Embodiments of the present application.

Further, where an average fluff coming out ratio of Embodiments 4 and 5 is about 0.05%, an average fluff coming out ratio of Comparative Examples 10 to 12 is about 0.24%. In other words, in Embodiments of the present application, a fluff coming out amount is suppressed by about 20% compared with Comparative Examples.

In Comparative Example 13, snarls are formed on piles, thereby suppressing the fluff coming out.

In Embodiments 6 and 7, the pile yarn is a soft twist yarn. The soft twist yarn is formed by removing a water-soluble yarn from a conjugated yarn that includes a water-insoluble twisted yarn having a twisting coefficient of 2.0 or greater. A ratio H/D of pile height to pile diameter is 40 times or greater, and a ratio H/D of pile height to pile diameter is 50 times or greater. A gap L between pile yarns is 0.5 mm or less. A ratio H/L of pile height to gap between pile yarns is 20 time or greater. The pile yarn has an English yarn count of a range between 50 and 120.

In Embodiments 6 and 7, at least two snarls are formed on each soft twist yarn-made pile, and thus the snarls of the neighboring piles entwine together.

Comparative Example 14 does not satisfy the above described conditions, and thus no snarl is formed on piles. Therefore, the neighboring piles do not entwine.

Detailed structures are different from one another in Embodiments and Comparative Examples. Therefore, it is hard to make a strict comparison therebetween. Where an average pile retaining performance of Embodiments 6 and 7 is about 4500 mN, the pile retaining performance never be more than 2000 mN in Comparative Example 14. In other words, the pile retaining performances of Embodiments of the present application are two times or greater than those of Comparative Examples. The pile retention property improves in Embodiments of the present application.

SUMMARY

The inventors found out a condition for reliable occurrence of snarls and a condition for entwinement of the snarls of the neighboring piles and applied the conditions to pile fabric.

The entwinement of snarls of the neighboring piles contributes to the remarkable improvement of the pile retention strength.

In a state of conjugated yarn, the yarn can be treated as well as a twisted yarn. Also, even in a case where a non-twisted yarn and a soft twist yarn is used for a pile yarn, snarls occur on piles, and thus the snarls of the neighboring piles entwine together. More specifically, the invention of the present application can be applied also to a non-twisted yarn (soft twist yarn)-made pile.

When applied also to a non-twisted yarn (soft twist yarn)-made pile, the fluff coming out can be suppressed more.

The invention claimed is:

1. A pile fabric for towel cloth comprising:

a base weave construction formed of a warp yarn and a weft yarn, and a plurality of loop piles formed from a pile yarn by weaving the pile yarn and the weft yarn;

wherein a ratio of a height of each of the loop piles to a diameter of the pile yarn is 51 times or greater, and the height of each of the loop piles is between 6.3 mm and 12 mm;

wherein the pile yarn is a twisted yarn made of cotton fibers and having a twisting coefficient of 2.0 or greater;

wherein each of the loop piles has a standup portion and a return portion, the pile yarn of the plurality of loop piles is twisted in the loop pile, the standup portion and the returning portion intersect to form an annular shape with an intersection point, a snarl is formed from the intersection point and the annular shape; and wherein the pile yarn has an English yarn count of a range between 50 and 120.

2. The pile fabric according to claim 1:

wherein the plurality of the pile yarns is arranged in parallel with the warp yarn; and wherein a gap between neighboring pile yarns is not greater than 0.5 mm.

3. The pile fabric according to claim 2:

wherein the snarls on the neighboring loop piles entwine together.

4. The pile fabric according to claim 2, wherein the plurality of the pile yarns is arranged between a neighboring warp yarns.

5. A manufacturing method of the pile fabric according to claim 4:

wherein the plurality of the pile yarns to be arranged between the neighboring warp yarns is drawn through the same dent of a reed for weaving; and wherein snarls are formed after weaving, and the snarls on the neighboring loop piles entwine together.

6. A pile fabric for towel cloth comprising:

a base weave construction formed of a warp yarn and a weft yarn, and a plurality of loop piles formed from a pile yarn by weaving the pile yarn and the weft yarn;

wherein a ratio of a height of each of the loop piles to a diameter of the pile yarn is 51 times or greater, and the height of each of the loop piles is between 6.3 mm and 12 mm;

wherein the pile yarn is a non-twisted yarn made of cotton fibers or a soft twist yarn made of cotton fibers;

wherein each of the loop piles has a standup portion and a return portion, the pile yarn of the plurality of loop piles is twisted in the loop pile, the standup portion and the returning portion intersect to form an annular shape with an intersection point, a snarl is formed from the intersection point and the annular shape; and wherein the pile yarn has an English yarn count of a range between 50 and 120.

7. The pile fabric according to claim 6:

wherein the plurality of the pile yarns is arranged in parallel with the warp yarn; and wherein a gap between neighboring pile yarns is not greater than 0.5 mm.

8. The pile fabric according to claim 7:

wherein the snarls on the neighboring loop piles entwine together.

9. The pile fabric according to claim 7, wherein the plurality of the pile yarns is arranged between the neighboring warp yarns.

10. A manufacturing method of the pile fabric according to claim 9:

wherein the plurality of the pile yarns to be arranged between the neighboring warp yarns is drawn through the same dent of a reed for weaving; and wherein snarls are formed after weaving, and the snarls on the neighboring loop piles entwine together.

11. A manufacturing method of the pile fabric according to claim 6:

wherein, in a conjugated yarn as the pile yarn, a water-soluble yarn is twisted in a direction reverse to a water-insoluble twisted yarn;

wherein the water-insoluble twisted yarn is a twisted yarn having a twisting coefficient of 2.0 or greater;

wherein the conjugated yarn is woven such that the plurality of loop piles are formed;

wherein the pile yarn is formed by removing the water-soluble yarn.

* * * * *